US011263996B2

(12) United States Patent
Ryu et al.

(10) Patent No.: US 11,263,996 B2
(45) Date of Patent: Mar. 1, 2022

(54) DISPLAY DEVICE

(71) Applicant: Samsung Display Co., LTD., Yongin-si (KR)

(72) Inventors: Anna Ryu, Hwaseong-si (KR); Sunghoon Kim, Seoul (KR); Suyeon Yun, Seoul (KR); Heejune Kwak, Hwaseong-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 16/838,029

(22) Filed: Apr. 2, 2020

(65) Prior Publication Data

US 2020/0320959 A1 Oct. 8, 2020

(30) Foreign Application Priority Data

Apr. 4, 2019 (KR) ..... 10-2019-0039436

(51) Int. Cl.
*G09G 5/14* (2006.01)
*G09G 3/3275* (2016.01)
*G09G 3/3266* (2016.01)

(52) U.S. Cl.
CPC ..... *G09G 5/14* (2013.01); *G09G 3/3266* (2013.01); *G09G 3/3275* (2013.01); *G09G 2380/02* (2013.01)

(58) Field of Classification Search
CPC ..... G09G 5/14; G09G 3/3275; G09G 3/3266; G09G 2380/02; G09G 2300/0408; G09G 2340/14; G09G 3/20; G09G 2310/0221; G09G 2300/026; G09G 2300/0426
See application file for complete search history.

(56) References Cited

U.S. PATENT DOCUMENTS

| | | | | |
|---|---|---|---|---|
| 7,540,106 | B2 | 6/2009 | Weiss | |
| 8,063,400 | B2 | 11/2011 | Sugimoto | |
| 10,255,863 | B2 | 4/2019 | Song et al. | |
| 2015/0012850 | A1 | 1/2015 | Wang et al. | |
| 2015/0234507 | A1 | 8/2015 | Chun et al. | |
| 2015/0287365 | A1* | 10/2015 | Song | G09G 3/344 345/206 |
| 2017/0287381 | A1* | 10/2017 | Park | G02F 1/1362 |
| 2017/0294492 | A1* | 10/2017 | Lv | H01L 27/326 |
| 2020/0312237 | A1* | 10/2020 | He | H01L 51/5253 |

FOREIGN PATENT DOCUMENTS

| | | | |
|---|---|---|---|
| JP | 200190048 | A | 4/2001 |
| KR | 1020120032659 | A | 4/2012 |
| KR | 1020150096952 | A | 8/2015 |
| KR | 1020150115618 | A | 10/2015 |
| KR | 101744893 | B1 | 6/2017 |

* cited by examiner

*Primary Examiner* — Sahlu Okebato
(74) *Attorney, Agent, or Firm* — Cantor Colburn LLP

(57) ABSTRACT

A display device includes a display panel including a first display area having a first shape and a second display area having a second shape, and a first driving circuit which drives the display panel to display an image in at least one of the first display area and the second display area, where the first display area includes a first sub-area and a second sub-area, and the second sub-area includes a light emitting area and a transmitting area adjacent to the light emitting area and having a higher light transmittance than the light emitting area.

27 Claims, 26 Drawing Sheets

DISPLAY DEVICE

DISPLAY DEVICE

This application claims priority to Korean Patent Application No. 10-2019-0039436, filed on Apr. 4, 2019, and all the benefits accruing therefrom under 35 U.S.C. § 119, the content of which in its entirety is herein incorporated by reference.

BACKGROUND

1. Field

Exemplary embodiments of the invention relate to a display device including a plurality of display areas.

2. Description of the Related Art

A variety of display devices, which are widely used in multimedia devices such as a television, a mobile phone, a tablet computer, a navigation device, and a game machine, are being developed. A display device generates an image and provides the image to a user through a display screen thereof.

Recently, various types of display devices are under development with the development of technology of display devices. For example, a flexible display device that may be changed into a curved surface shape, or may be folded or rolled is being developed.

SUMMARY

Recently, a technique for simultaneously displaying different information such as a movie, an advertisement, and a guidance message on a single display device is desired.

Exemplary embodiments of the invention provide a display device including a plurality of display areas capable of simultaneously providing different images or information.

Exemplary embodiments of the invention provide a display device including: a display panel including a first display area having a first shape and a second display area having a second shape; and a first driving circuit which drives the display panel to display an image in at least one of the first display area and the second display area. In such an embodiment, the first display area includes a first sub-area and a second sub-area, and the second sub-area includes a light emitting area and a transmitting area adjacent to the light emitting area and having a higher light transmittance than the light emitting area.

In an exemplary embodiment, the second sub-area may be disposed adjacent to the second display area.

In an exemplary embodiment, the display panel may include: a base substrate; a circuit element layer disposed on the base substrate; a first electrode disposed on the circuit element layer in correspondence to the light emitting area; a light emitting layer disposed on the first electrode in correspondence to the light emitting area; and a second electrode disposed on the light emitting layer.

In an exemplary embodiment, the display panel may include: a base substrate; a circuit element layer disposed on the base substrate; a first electrode disposed on the circuit element layer in correspondence to the light emitting area; a pixel defining film disposed on the circuit element layer to define the light emitting area and the transmitting area; a light emitting layer disposed on the first electrode in correspondence to the light emitting area; and a second electrode which is disposed on the light emitting layer and has a structure in which the second electrode may not overlap the transmitting area.

In an exemplary embodiment, the first display area may include a first driving area, and the second display area may include a second driving area and a third driving area, where the first driving area includes a first scan driver which drives a plurality of first scan lines, and first pixels respectively connected to the plurality of first scan lines, the second driving area includes a second scan driver which drives a plurality of second scan lines, and second pixels respectively connected to the plurality of second scan lines, and the third driving area includes a third scan driver which drives a plurality of third scan lines, and third pixels respectively connected to the plurality of third scan lines.

In an exemplary embodiment, the first driving circuit may include: a driving controller which outputs a data signal and a data control signal; and a data driver which drives first data lines and second data lines in response to the data signal and the data control signal. In such an embodiment, each of the first pixels and the third pixels may be connected to a corresponding one of the second data lines, and each of the second pixels may be connected to a corresponding one of the first data lines.

In an exemplary embodiment, the driving controller may further output first to third scan control signals, where the first to third scan drivers may operate in synchronization with the first to third scan control signals, respectively.

In an exemplary embodiment, the driving controller may output the first to third scan control signals in a way such that at least one of the first to third scan drivers is activated.

In an exemplary embodiment, the display device may further include a second driving circuit, where the first driving circuit may drive the first display area to display an image in the first display area, and the second driving circuit may drive the second display area to display an image in the second display area.

In an exemplary embodiment, the first driving circuit may include: a first driving controller which outputs a first data signal and a first data control signal; and a first data driver which drives first data lines in response to the first data signal and the first data control signal. In such an embodiment, the second driving circuit may include: a second driving controller which outputs a second data signal and a second data control signal; and a second data driver which drives second data lines and third data lines in response to the second data signal and the second data control signal. In such an embodiment, each of the first pixels may be connected to a corresponding one of the first data lines, each of the second pixels may be connected to a corresponding one of the second data lines, and each of the third pixels may be connected to a corresponding one of the third data lines.

In an exemplary embodiment, the first driving controller may further output a first scan control signal, and the first scan driver may operate in synchronization with the first scan control signal.

In an exemplary embodiment, the second driving controller may further output a second scan control signal and a third scan control signal, where the second scan driver may operate in synchronization with the second scan control signal, and the third scan driver may operate in synchronization with the third scan control signal.

In an exemplary embodiment, the first shape and the second shape may be different from each other in at least one of area and shape.

In an exemplary embodiment, the display device may further include an electronic module disposed to overlap the display panel, where the transmitting area of the second sub-area may overlap the electronic module.

In an exemplary embodiment, the second sub-area may be disposed adjacent to the second display area.

In an exemplary embodiment, the first display area may include a first driving area, and the second display area may include a second driving area and a third driving area, where the first driving area may include a first scan driver which drives a plurality of first scan lines, and first pixels respectively connected to the plurality of first scan lines, the second driving area includes a second scan driver which drives a plurality of second scan lines, and second pixels respectively connected to the plurality of second scan lines, and the third driving area may include a third scan driver which drives a plurality of third scan lines, and third pixels respectively connected to the plurality of third scan lines.

In an exemplary embodiment, the first driving circuit may include: a driving controller which outputs a data signal and a data control signal; and a data driver which drives first data lines and second data lines in response to the data signal and the data control signal, where each of the first pixels and the third pixels is connected to a corresponding one of the second data lines, and each of the second pixels is connected to a corresponding one of the first data lines.

In an exemplary embodiment, the driving controller may further output first to third scan control signals, where the first to third scan drivers may operate in synchronization with the first to third scan control signals, respectively.

In an exemplary embodiment of the invention, a display device includes: a display panel including a first display area having a first shape and a second display area having a second shape; and a first driving circuit which drives the display panel to display an image in at least one of the first display area and the second display area, where the display panel is bendable with respect to a first bending axis in a boundary area between the first display area and the second display area, which are adjacent to each other.

In an exemplary embodiment, the first display area may include a first sub-area and a second sub-area, and the second sub-area may include a light emitting area and a transmitting area adjacent to the light emitting area and having a higher light transmittance than the light emitting area, where the second sub-area is disposed adjacent to the second display area.

In an exemplary embodiment, in a state where the display panel is bent with respect to the first bending axis, the first driving circuit may drive the display panel to display an image in any one of the first display area and the second display area.

In an exemplary embodiment, the display device may further include a second driving circuit, where the first driving circuit may drive the first display area to display an image in the first display area, and the second driving circuit may drive the second display area to display an image in the second display area.

Exemplary embodiments of the invention provide a display device including a display panel including a composite area having a first shape and a second display area having a second shape; and a driving circuit which drives the display panel to display an image in at least one of the composite area and the second display area, where the composite area includes a first display area which displays the image and a transparent area which does not to display the image.

In an exemplary embodiment, the driving circuit may drive the display panel to display the image in both the first display area and the second display area in a first mode.

In an exemplary embodiment, the driving circuit may drive the display panel to display the image in one of the first display area and the second display area in a second mode.

In an exemplary embodiment, the second display area may include a first driving area and a second driving area, and the driving circuit may drive the display panel to display the image in the first display area and at least one of the first driving area and the second driving area in a third mode.

In an exemplary embodiment, the transparent area may be adjacent to at least one of the first driving area and the second driving area.

BRIEF DESCRIPTION OF THE FIGURES

The above and other features of the invention will become more apparent by describing in detail exemplary embodiments thereof with reference to the attached drawings, in which.

DETAILED DESCRIPTION

Figure 1A:
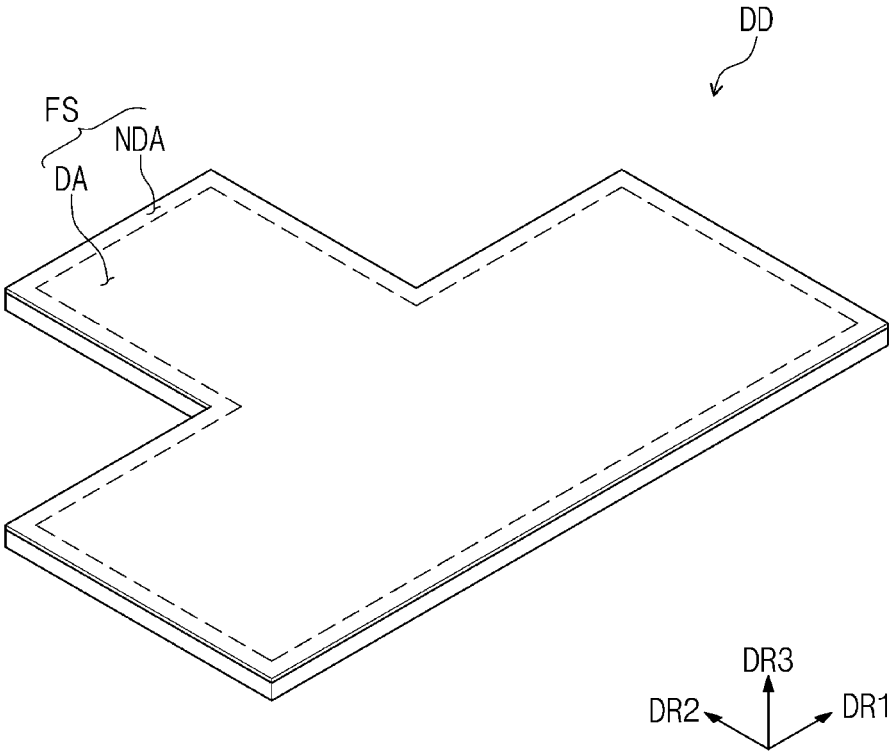
FIG. 1A is a perspective view of a display device according to an exemplary embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer, or intervening elements or layers may be present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the context clearly indicates otherwise. "Or" means "and/or." "At least one of A and B" means "A and/or B." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", and "upper", may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

Figure 1B:
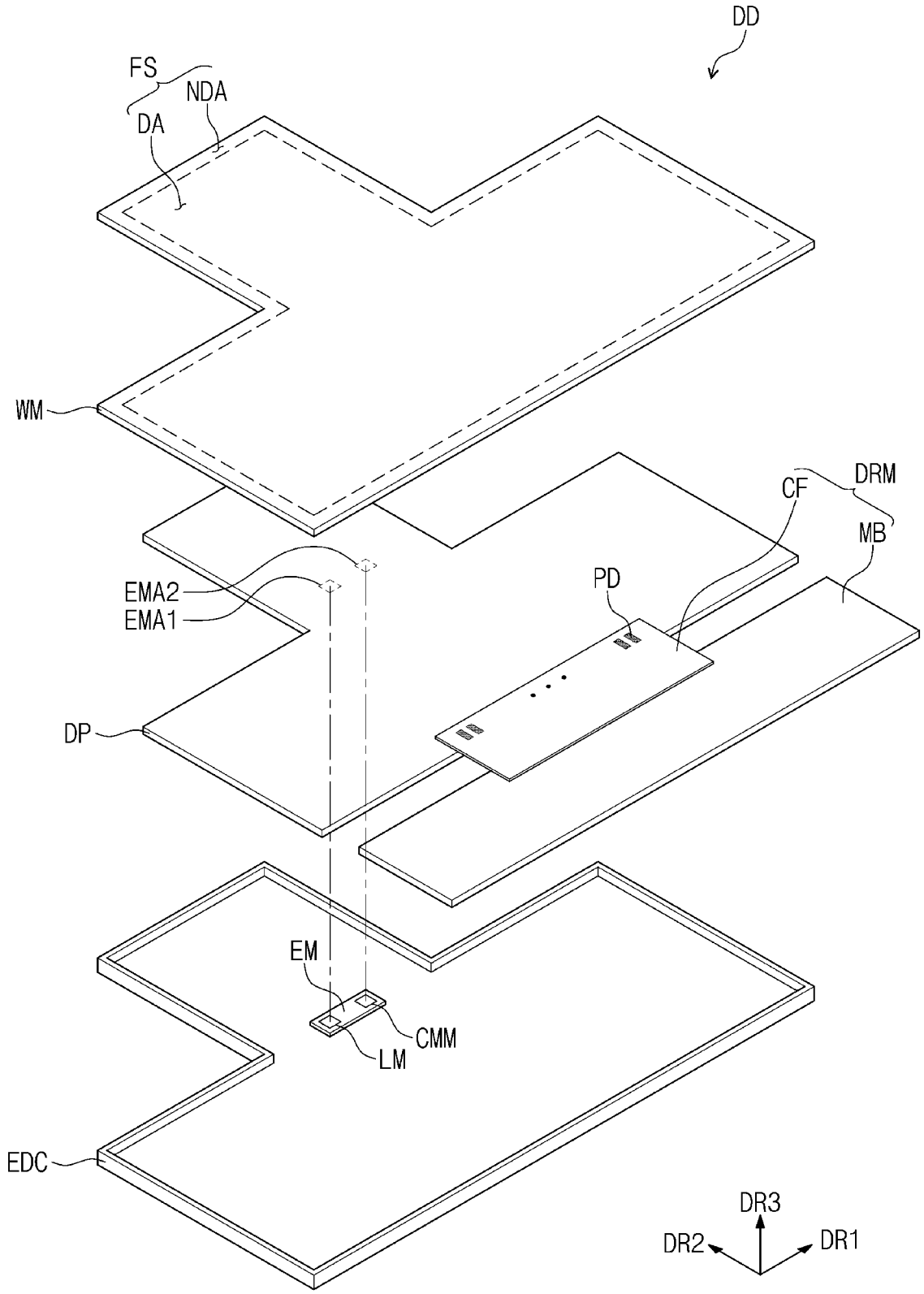
FIG. 1B is an exploded perspective view of the display device illustrated in FIG. 1A.

FIG. 1A is a perspective view of a display device according to an exemplary embodiment of the invention. FIG. 1B is an exploded perspective view of the display device illustrated in FIG. 1A.

Referring to FIG. 1A, an exemplary embodiment of a display device DD may be one of portable terminals such as a tablet personal computer ("PC"), a smartphone, a personal digital assistant ("PDA"), a portable multimedia player ("PMP"), a game machine, a wrist watch type electronic device, and a navigation device. In an alternative embodiment of the invention, the display device DD may be one of various information providing devices such as a television, a computer monitor, and a digital signage.

An exemplary embodiment of the invention may be used in large-sized electronic apparatuses such as a television and an outdoor advertising display apparatus, and in small- and medium-sized electronic devices such as a personal computer, a laptop computer, a car navigation device, and a camera. These are merely exemplary, and an exemplary embodiment of the invention may also be employed in other electronic devices as long as the other electronic devices do not deviate from the invention.

In an exemplary embodiment, as illustrated in FIG. 1A, a display surface FS, on which an image is displayed, is parallel to a plane defined by a first direction DR1 and a second direction DR2. The display device DD includes a plurality of areas that are divided on the display surface FS. The display surface FS includes a display area DA in which the image is displayed, and a non-display area NDA adjacent to the display area DA. The non-display area NDA may be referred to as a bezel area. The non-display area NDA surrounds the display area DA. In an exemplary embodiment, although not illustrated, a partially curved shape, for example, may be included in the display device DD. In such an embodiment, a portion of the display area DA may have a curved shape.

A front surface (or a top surface, or a first surface) and a rear surface (or a bottom surface, or a second surface) of each member are defined with respect to a direction in which the image is displayed (for example a third direction DR3). However, directions indicated by the first to second directions DR1 to DR2 and a third direction DR3 are a relative concept, and may be converted into different directions. Hereinafter, first to third directions are indicated by reference characters DR1 to DR3, respectively, as shown in the drawings.

In an exemplary embodiment, as illustrated in FIG. 1B, the display device DD may include a window module WM, a display panel DP, a driving module DRM, an electronic module EM, and an outer case EDC.

The display panel DP is not particularly limited to a specific type of display panel. In one exemplary embodiment, for example, the display panel DP may be a light emitting display panel such as an organic light emitting display panel, or a quantum dot light emitting display panel.

Although not illustrated in the figure, an optical film and an input sensor may further be included in the display device DD. An optical film decreases reflectance of external light. An input sensor (e.g., a touch panel) senses an external input of a user. The display device DD may further include an adhesive layer for bonding the optical film and the input sensor to each other.

The window module WM and the outer case EDC are combined to define an outermost appearance of the display device DD. In such an embodiment, the display device DD may further include other components in addition to the components illustrated in FIG. 1B and is not limited to any specific embodiment.

The window module WM is disposed on the display panel DP to cover a front surface of the display panel DP. The window module WM may include an optically transparent insulating material. In one exemplary embodiment, for example, the window module WM may include a glass or a plastic. The window module WM may have a multilayer or single layer structure. In one exemplary embodiment, for example, the window module WM may have a laminated structure of a plurality of plastic films bonded to each other by an adhesive, or have a laminated structure of a glass substrate and a plastic film bonded to each other by an adhesive.

The window module WM includes a display surface FS exposed to an outside. The display surface FS of the display device DD may be defined by the display surface FS of the window module WM.

Figure 3:
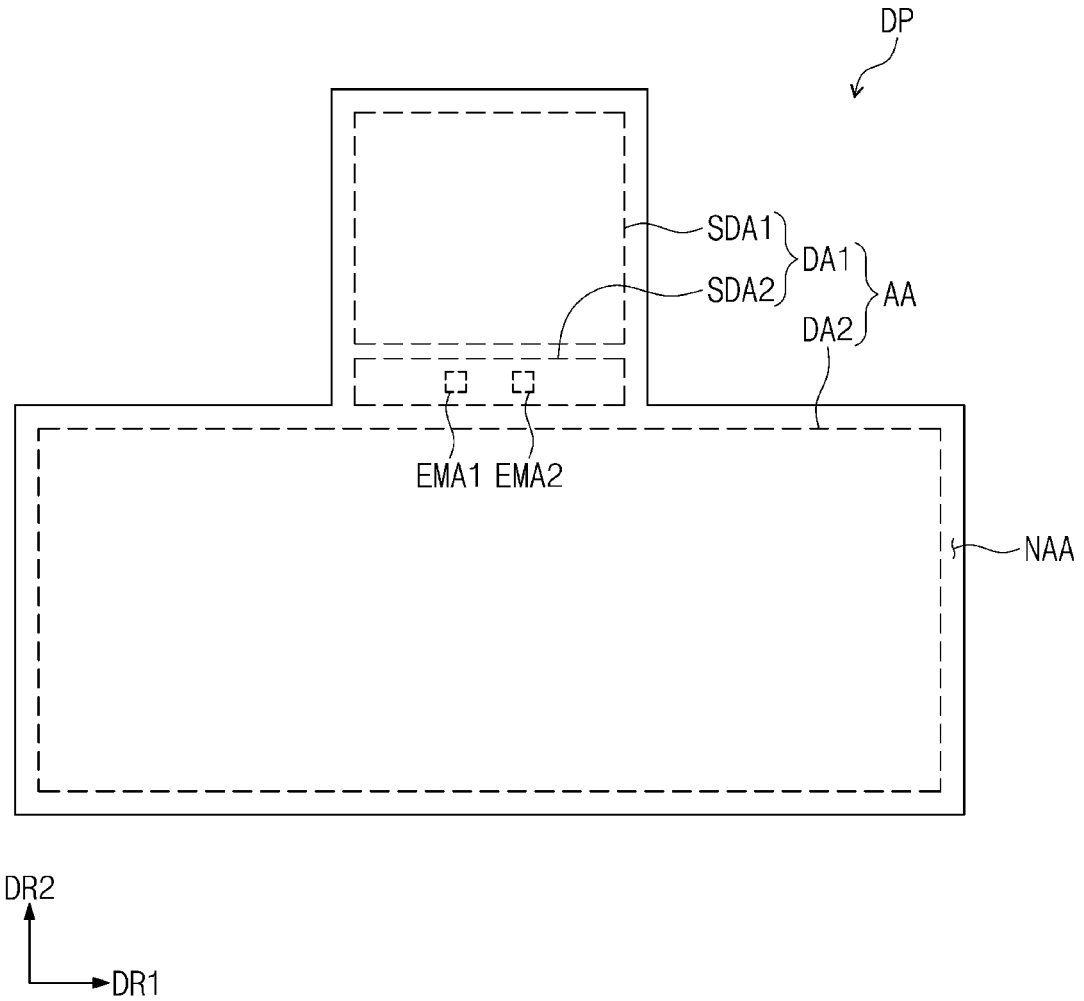
FIG. 3 is a plan view illustrating an exemplary embodiment of display areas of a display panel.

In an exemplary embodiment, the display area DA may be an optically transparent area. The display area DA may have a shape corresponding to an active area AA of the display panel DP (as shown in FIG. 3). In one exemplary embodiment, for example, the display area DA overlaps an entire surface of, or at least a portion of, the active area AA. An image displayed in the active area AA of the display panel DP may be viewed from the outside through the display area DA.

The non-display area NDA may be an area having a lower light transmittance when compared with the display area DA. The non-display area NDA defines the shape of the display area DA. The non-display area NDA may be adjacent to and surround the display area DA.

The non-display area NDA may have a predetermined color. In an exemplary embodiment, where the window module WM includes a glass or plastic substrate, the non-display area NDA may be formed by a color layer printed or deposited on a surface of the glass or plastic substrate. Alternatively, the non-display area NDA may be formed by coloring a corresponding area of the glass or plastic substrate.

The non-display area NDA may cover a peripheral area NAA of the display panel DP (as shown in FIG. 3) to block the peripheral area NAA from being viewed from the outside, but not being limited thereto. Alternatively, the non-display area NDA may be omitted in the window module WM.

The display panel DP may display the image. The display panel DP includes the front surface including the active area AA and the peripheral area NAA. The active area AA may be activated according to an electrical signal, and is an area in which the image is displayed. The peripheral area NAA may be an area covered by the non-display area NDA. The peripheral area NAA is adjacent to the active area AA. The peripheral area NAA may surround the active area AA. A driving circuit, driving wires or the like for driving the active area AA may be disposed in the peripheral area NAA.

Various signal lines, pads PD, an electronic element, or the like for providing an electrical signal to the active area AA may be disposed in the peripheral area NAA. The peripheral area NAA may be covered by the non-display area NDA and may not be viewed from the outside.

In such an embodiment, the display panel DP is assembled in a flat state in which the active area AA and the peripheral area NAA face the window module WM. However, this is merely exemplary, and alternatively, a portion of the display panel DP may be bent. Alternatively, the peripheral area NAA may be omitted in the display panel DP.

At least one electronic module area may be defined in the display panel DP. In an exemplary embodiment, as shown in FIG. 1B, the display panel DP includes a first electronic module area EMA1 and a second electronic module area EMA2 defined therein, but is not limited thereto. Alternatively, a single electronic module area or three or more electronic module areas may be defined in the display panel DP. The first electronic module area EMA1 and the second electronic module area EMA2 may have a relatively higher light transmittance than the active area AA. The first electronic module area EMA1 and the second electronic module area EMA2 are defined at positions overlapping, when viewed in a top plan view, electronic elements LM and CMM in the electronic module EM to be described later.

At least a portion of the first electronic module area EMA1 and the second electronic module area EMA2 may be surrounded by the active area AA. In an exemplary embodiment, the first electronic module area EMA1 and the second electronic module area EMA2 are spaced apart from the peripheral area NAA. In an exemplary embodiment, as shown in FIG. 1B, the first electronic module area EMA1 and the second electronic module area EMA2 are defined within the active area AA such that all edges thereof are surrounded by the active area AA.

In an exemplary embodiment, as shown in FIG. 1B, the first electronic module area EMA1 and the second electronic module area EMA2 have a quadrangular shape, but not being limited thereto. Alternatively, the first electronic module area EMA1 and the second electronic module area EMA2 may have a shape of a polygon, an ellipse, or a closed line including a curve in at least a portion thereof, or may be provided in a shape including a plurality of patterns partially disconnected.

The driving module DRM may be connected to the display panel DP. The driving module DRM may include a flexible board CF and a main board MB. The flexible board CF may include an insulating film and conductive wires mounted on the insulating film. The conductive wires are connected to the pads PD and electrically connect the driving module DRM to the display panel DP.

In an exemplary embodiment, the flexible board CF may be assembled in a bent state. Accordingly, the main board MB may be stably accommodated in a space provided by the outer case EDC, by being disposed on a rear surface of the display panel DP. Alternatively, the flexible board CF may be omitted, and the main board MB may be connected directly to the display panel DP.

The main board MB may include signal lines and electronic elements not illustrated. The electronic elements may be connected to the signal lines and electrically connected to the display panel DP. The electronic elements generate various electrical signals, for example, a signal for generating the image, or process a detected signal. In an exemplary embodiment, the main board MB may be provided in plural, but not being limited thereto.

The electronic module EM is disposed below the display panel DP. The electronic module EM may overlap the first electronic module area EMA1 and the second electronic module area EMA2 when viewed in a plan view. The electronic module EM may receive an external input transmitted through the first electronic module area EMA1 and the second electronic module area EMA2, or may provide an output through the first electronic module area EMA1 and the second electronic module area EMA2.

The electronic module EM may include a receiving part for receiving an external input or an output part for providing an output, which may overlap the first electronic module area EMA1 and the second electronic module area EMA2 when viewed in a plan view. A part or the entirety of the electronic module EM may be accommodated in the first electronic module area EMA1 and the second electronic module area EMA2. According to an exemplary embodiment of the invention, the electronic module EM may prevent, by being disposed to overlap the active area AA, the peripheral area NAA from being increased. In such an embodiment, the electronic module EM may easily recognize a user's gaze or face by being disposed in a vicinity of the center of the display area DA.

Figure 2:
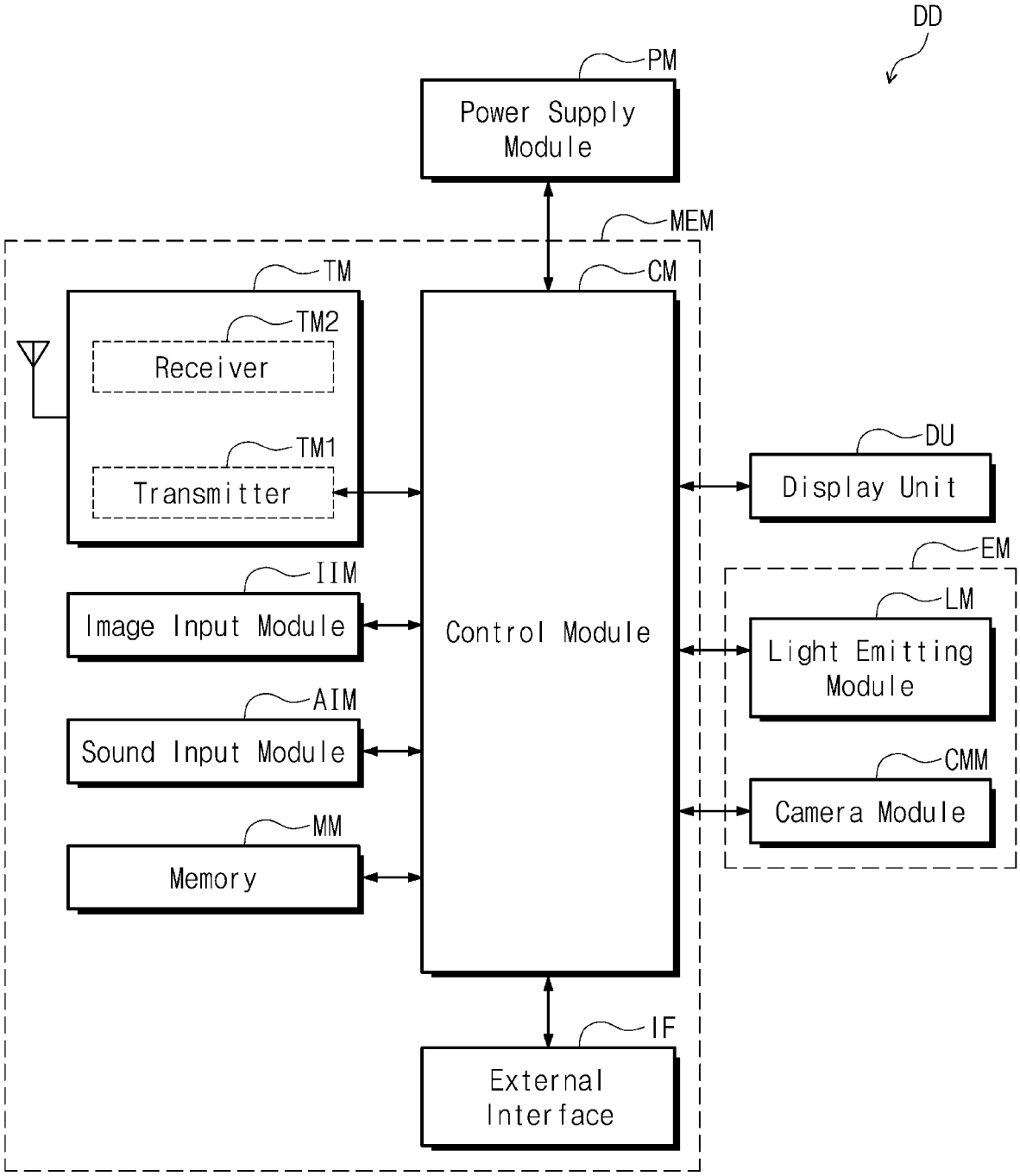
FIG. 2 is a block diagram of the display device illustrated in FIG. 1A.

FIG. 2 is a block diagram of the display device illustrated in FIG. 1A.

Referring to FIG. 2, the display device DD may include a display unit DU, a power supply module PM, a main electronic module MEM, and the electronic module EM. The display unit DU, the power supply module PM, the main electronic module MEM, and the electronic module EM may be electrically connected to each other. The display unit DU of FIG. 2 may include the display panel DP and the driving module DRM illustrated in FIG. 1B.

The power supply module PM provides power used for an overall operation of the display device DD. The power supply module PM may include a typical battery module.

The main electronic module MEM and the electronic module EM include various functional modules for operating the display device DD. The main electronic module MEM may be directly mounted on a motherboard electrically connected to the display unit DU, or may be mounted on a separate board to be electrically connected to the motherboard through a connector (not illustrated) or the like.

The main electronic module MEM may include a control module CM, a wireless communication module TM, an image input module IIM, a sound input module AIM, a memory MM, and an external interface IF. Some of the modules may also be electrically connected to the motherboard through a flexible circuit board instead of being mounted on the motherboard.

The control module CM controls an overall operation of the display device DD. The control module CM may be a microprocessor. In one exemplary embodiment, for example, the control module CM activates or deactivates the display unit DU. The control module CM may control other modules such as the image input module IIM and the sound input module AIM.

The wireless communication module TM may transmit/receive a radio signal to/from another terminal by using a Bluetooth or Wi-Fi channel. The wireless communication module TM may transmit/receive a voice signal by using a general communication channel. The wireless communication module TM includes a transmitter TM1 for modulating and transmitting a signal to be transmitted, and a receiver TM2 for demodulating a received signal.

The image input module TIM processes an image signal and converts the processed image signal into image data that may be displayed on the display unit DU. The sound input module AIM receives an external sound signal using a microphone in a recording mode, a voice recognition mode, or the like, and converts the received signal into electrical sound (or voice) data.

The external interface IF serves as an interface to which an external charger, a wired/wireless data port, a card (e.g., a memory card and a SIM/UIM card) socket, and the like are connected.

The electronic module EM may include a light emitting module LM and a camera module CMM. The components may be directly mounted on the motherboard, or may be mounted on a separate board to be electrically connected to the display unit DU or electrically connected to the main electronic module MEM via a connector (not illustrated) and the like.

The light emitting module LM generates and outputs light. The light emitting module LM may output infrared rays. The light emitting module LM may include an light emitting diode ("LED") element. The camera module CMM captures an external image.

The electronic module EM may further include a sound output module, and sensors such as a light sensor and a heat sensor, in addition to the components described above. In an exemplary embodiment, the light emitting module LM and the camera module CMM of the electronic module EM may be disposed to overlap the first electronic module area EMA1 and the second electronic module area EMA2, respectively, as illustrated in FIG. 1B.

FIG. 3 is a plan view illustrating an exemplary embodiment of display areas of the display panel.

Referring to FIG. 3, the display panel DP includes the active area AA and the peripheral area NAA. The active area AA includes a first display area DA1 and a second display area DA2. In an exemplary embodiment, the area of the first display area DA1 is smaller than the area of the second display area DA2. Each of the first display area DA1 and the second display area DA2 may have a quadrangular shape, and one side of the first display area DA1 and one side of the second display area DA2 may be adjacent to each other, but embodiments of the invention are not limited thereto. In an alternative exemplary embodiment, the shape of each of the first display area DA1 and the second display area DA2 may be any one of a circle and a polygon such as a triangle and a quadrangle, and the first display area DA1 and the second display area DA2 may have different shapes and/or different areas from each other.

The first display area DA1 includes a first sub-area SDA1 and a second sub-area SDA2. The second sub-area SDA2 is adjacent to the second display area DA2.

In an exemplary embodiment, the second sub-area SDA2 may have a higher light transmittance than the first sub-area SDA1 and the second display area DA2. The first electronic module area EMA1 and the second electronic module area EMA2 are defined in the second sub-area SDA2. In such an embodiment, as described above, the light emitting module LM and the camera module CMM are arranged in rear surfaces of the first electronic module area EMA1 and the second electronic module area EMA2. The light emitting module LM and the camera module CMM arranged to overlap the second sub-area SDA2 having a high light transmittance may easily detect an external subject or easily provide an outputted optical signal to the outside.

In such an embodiment, the second sub-area SDA2 is flexible and thus the shape thereof may be changed by bending, folding, rolling, or the like.

In an exemplary embodiment, as described above, the second sub-area SDA2 is adjacent to the second display area DA2, but embodiments of the invention are not limited thereto. In one alternative exemplary embodiment, for example, the second sub-area SDA2 may be disposed apart from the second display area DA2. In another alternative exemplary embodiment, an area having a higher light transmittance than other areas may be disposed in a portion of the second display area DA2. In another alternative exemplary embodiment, the active area AA may be divided into three or more display areas.

Figure 4:
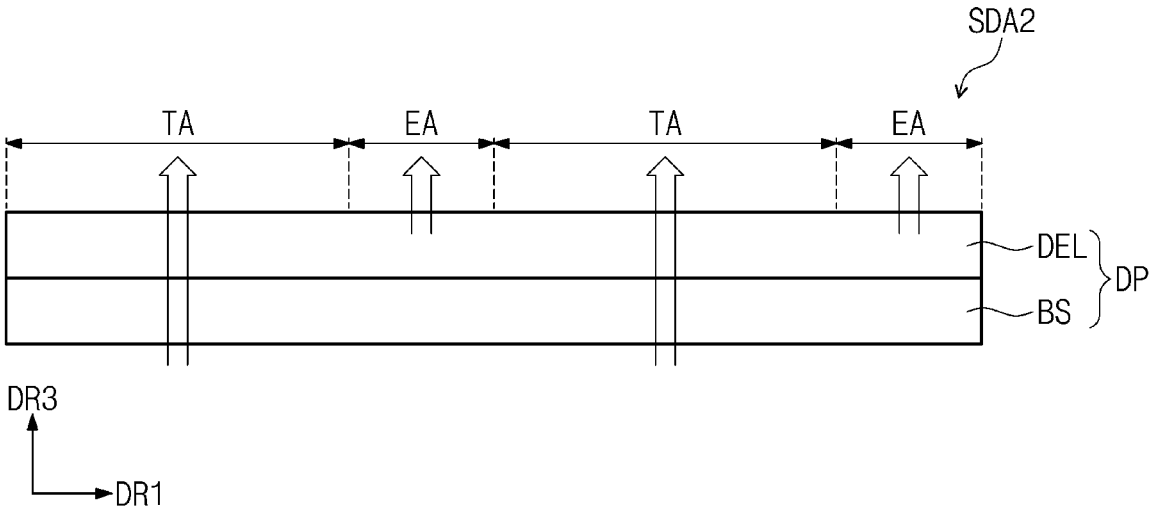
FIG. 4 is a schematic cross-sectional view illustrating a second sub-area of the display panel illustrated in FIG. 3.

FIG. 4 is a schematic cross-sectional view illustrating the second sub-area of the display panel illustrated in FIG. 3.

Referring to FIG. 4, the second sub-area SDA2 of the display panel DP includes a base substrate BS and a display element layer DEL disposed on the base substrate BS. The display element layer DEL of the second sub-area SDA2 may include a light emitting layer that emits internal light. The light emitting layer is provided in correspondence to each of a plurality of light emitting areas EA. Accordingly, the second sub-area SDA2 of the display panel DP may display an image through the plurality of light emitting areas EA. In such an embodiment, the second sub-area SDA2 of the display panel DP may transmit external light through each of transmitting areas TA. Accordingly, the second sub-area SDA2 of the display panel DP allows the light emitting module LM and the camera module CMM disposed therebelow to easily detect an external subject or easily provide an outputted optical signal to the outside while displaying an image through the light emitting area EA.

Various elements and wires are disposed in an area of the display element layer DEL corresponding to the light emitting area EA, so that the amount of transmission of external light incident on the light emitting area EA is extremely low, or external light may not effectively passes through the light emitting area EA. However, because various elements and wires are not provided in an area of the display element layer DEL corresponding to the transmitting area TA, the transmittance of the transmitting area TA for external light may be improved.

An exemplary embodiment having a structure in which the transmitting area TA is disposed immediately adjacent to the light emitting area EA is illustrated in FIG. 4, but not being limited thereto. Alternatively, a non-light emitting area may further be provided between the light emitting area EA and the transmitting area TA.

Figure 5:
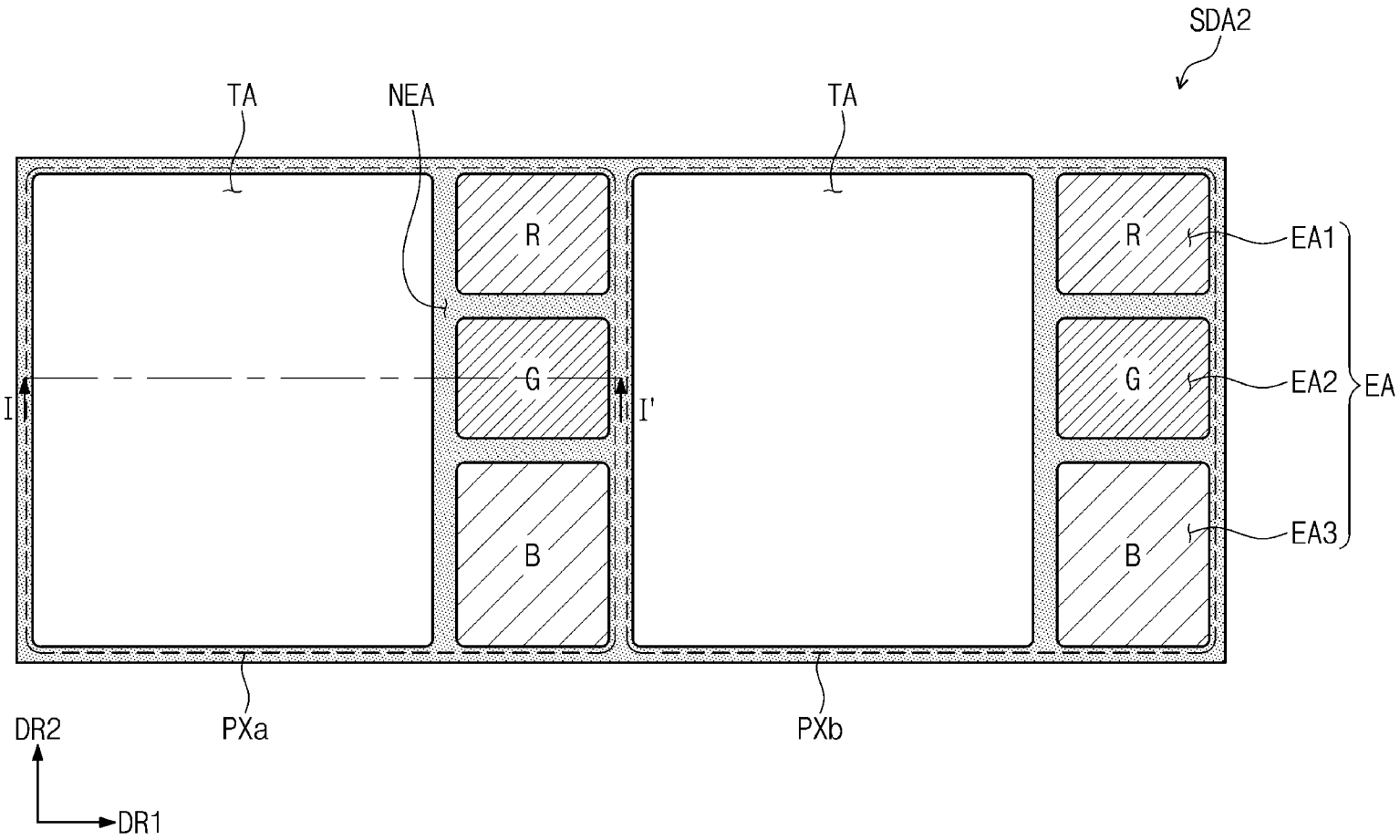
FIG. 5 is a plan view illustrating a pixel structure of the second sub-area of the display panel illustrated in FIG. 3.

FIG. 5 is a plan view illustrating a pixel structure of the second sub-area of the display panel illustrated in FIG. 3.

Referring to FIG. 5, the second sub-area SDA2 of the display panel DP may include a plurality of pixels. Each of the plurality of pixels may include the light emitting area EA, a non-light emitting area NEA, and the transmitting area TA. FIG. 5 illustrates two adjacent pixels PXa and PXb among the plurality of pixels. The two pixels PXa and PXb may have a substantially same structure as each other. In such an embodiment, the plurality of pixels may have a substantially same structure as each other.

Each of the pixels PXa and PXb may include a plurality of sub-pixels. The light emitting area EA includes a plurality of light emitting areas EA1, EA2, and EA3 corresponding to the plurality of sub-pixels, respectively. The transmitting area TA is disposed adjacent to the plurality of light emitting areas EA1, EA2, and EA3.

In an exemplary embodiment, as illustrated in FIG. 5, each of the pixels PXa and PXb may include a first sub-pixel that displays a red color R, a second sub-pixel that displays a green color G, and a third sub-pixel that displays a blue color B, for example. The first to third sub-pixels may have a same size as each other, or at least one thereof may have a different size from the remaining pixels thereof. In an exemplary embodiment, as illustrated in FIG. 5, the third sub-pixel may have a larger size than the first and second sub-pixels. In such an embodiment, a third light emitting area EA3 corresponding to the third sub-pixel may have a larger size than first and second light emitting areas EA1 and EA2 corresponding to the first and second sub-pixels, respectively.

The transmitting area TA may have a size larger than the sum of sizes of the first to third sub-pixels. However, the size of the transmitting area TA is not limited thereto and may be variously modified according to a desired light transmittance of the second sub-area SDA2 of the display panel DP.

In an exemplary embodiment, as shown in FIG. 5, each of the pixels PXa and PXb includes a single transmitting area TA, but embodiments of the invention are not limited thereto. Alternatively, each of the pixels PXa and PXb may have a plurality of transmitting areas TA. In one exemplary embodiment, for example, each of the pixels may include three transmitting areas adjacent to the first to third sub-pixels, respectively.

In an exemplary embodiment, each of the light emitting areas EA1 to

EA3 has a quadrangular shape defined by the first and second directions DR1 and DR2 as illustrated in FIG. 5, but the shape of each of the light emitting areas EA1 to EA3 is not limited thereto. In one alternative exemplary embodiment, for example, each of the light emitting areas EA1 to EA3 may have a rhombic shape. In an exemplary embodiment, the transmitting area TA may have a quadrangular shape defined by the first and second directions DR1 and DR2, but not being limited thereto. Alternatively, the shape of the transmitting area TA may be variously modified depending on the shape of each of the light emitting areas EA1 to EA3.

In an exemplary embodiment, as illustrated in FIGS. 4 to 5, each of the pixels PXa and PXb in the second sub-area SDA2 of the display panel DP has the transmitting area TA, but embodiments of the invention are not limited thereto. Alternatively, only a portion of the second sub-area SDA2 may be implemented as a transparent display area. In such an embodiment, only pixels disposed at positions overlapping, when viewed in a plan view, the electronic elements LM and CMM in the electronic module EM may have the transmitting area TA, and pixels not overlapping the electronic elements LM and CMM, when viewed in a plan view, may not have the transmitting area TA. Accordingly, in such an embodiment, an external object or image may be viewed through the transmitting area TA in the transparent display area of the second sub-area SDA2 while an image may be displayed through the light emitting area EA in the transparent display area of the second sub-area SDA2, and an image may be displayed through the light emitting area EA in a remaining display area.

Figure 6A:
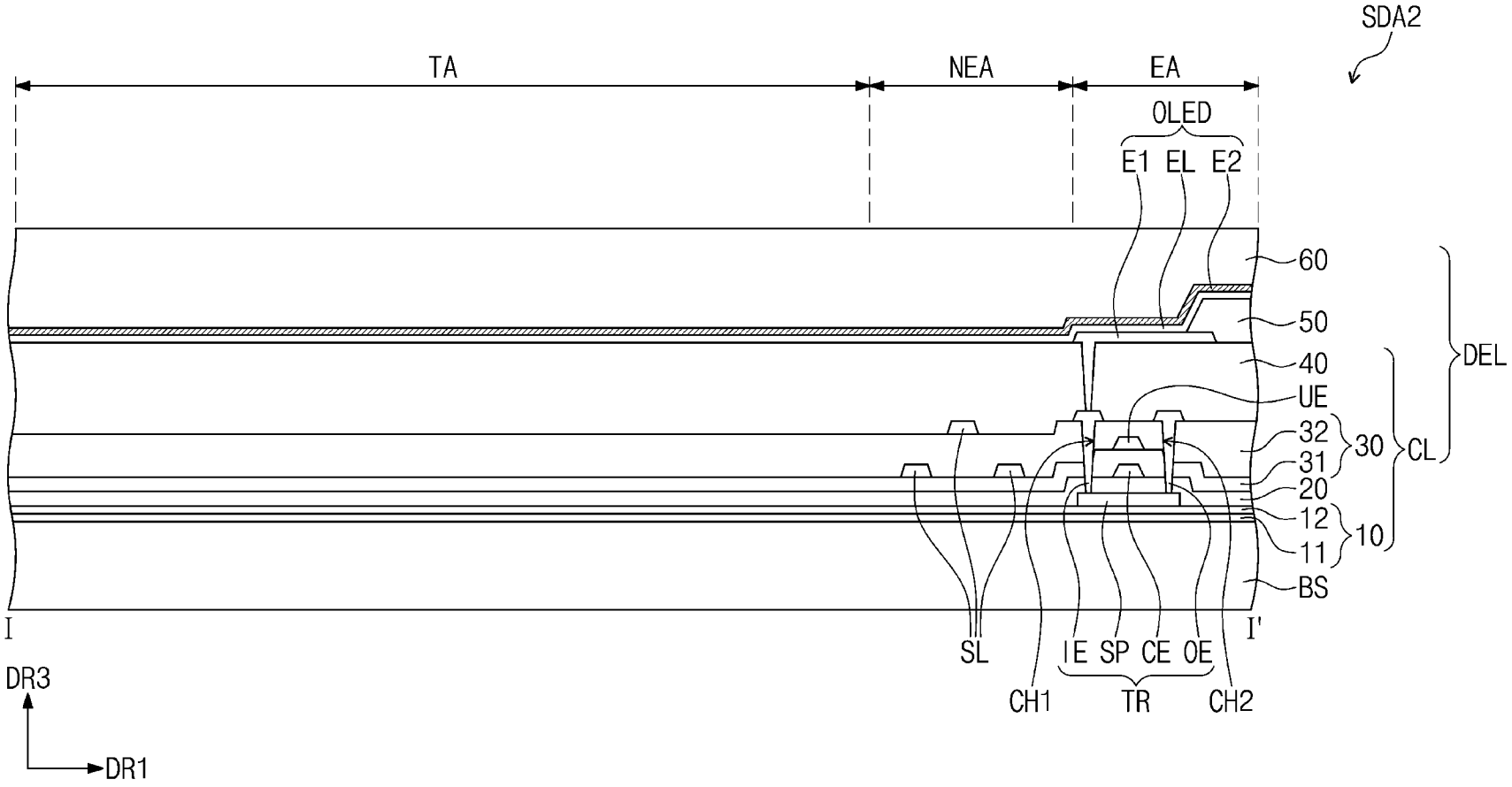
FIGS. 6A and 6B are cross-sectional views, taken along line I-I' of a transparent display area of the display panel illustrated in FIG. 5, illustrating a display element layer therein.
Figure 6B:
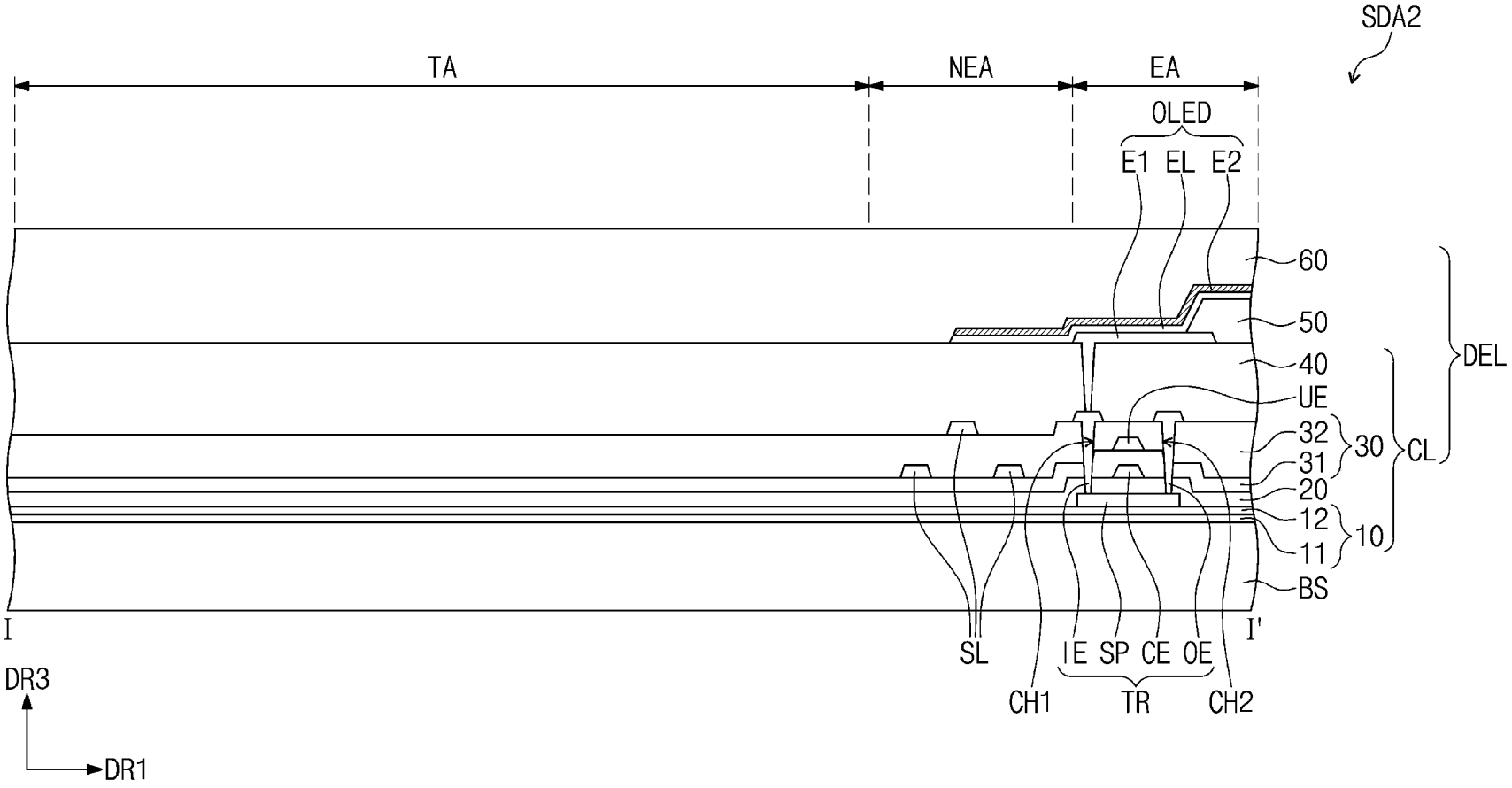

FIGS. 6A and 6B are cross-sectional views, taken along line I-I' of a transparent display area of the display panel illustrated in FIG. 5, illustrating the display element layer therein.

Referring FIGS. 5, 6A and 6B, an exemplary embodiment of the display panel DP may include the base substrate BS and the display element layer DEL, and the display element layer DEL may include a first insulating layer 10, a second insulating layer 20, a third insulating layer 30, a fourth insulating layer 40, a fifth insulating layer 50, a light emitting layer EL, and an encapsulation layer 60. Although not illustrated, at least one of a touch sensor, an anti-reflection layer, and a window may further be included in the display element layer DEL.

The base substrate BS may be a silicon substrate, a plastic substrate, a glass substrate, an insulating film, or may have a laminated structure including a plurality of insulating layers.

The first insulating layer 10 includes a barrier layer 11 and a buffer layer 12. The first insulating layer 10 may have a single layer structure in which one of the barrier layer 11 and the buffer layer 12 is omitted, or may have a laminated structure of a plurality of layers, but not being limited thereto.

A circuit element layer CL may include a sub-pixel circuit disposed in each of the sub-pixels and a plurality of signal lines SL connected to the sub-pixel circuit. The sub-pixel circuit may include a plurality of transistors TR and a capacitor. Although one of the transistors TR is illustrated in FIG. 6A for convenience of illustration, the structure and the number of the transistors TR are not limited thereto.

Each of the transistors TR is disposed on the first insulating layer 10. The transistor TR includes a semiconductor layer SP, a control electrode CE, an input electrode IE, and an output electrode OE. The semiconductor layer SP is disposed on the first insulating layer 10. The semiconductor layer SP may include a semiconductor material. The control electrode CE is spaced apart from the semiconductor layer SP with the second insulating layer 20 therebetween.

The semiconductor layer SP is disposed on the buffer layer 12. The semiconductor layer SP may function as a channel area of the transistor TR. The semiconductor layer SP may include at least one selected from amorphous silicon, polysilicon, and an oxide semiconductor.

The second insulating layer 20 may be disposed on the semiconductor layer SP. The second insulating layer 20 may insulate the control electrode CE from the semiconductor layer SP.

The control electrode CE may be disposed on the second insulating layer 20. The control electrode CE may be disposed to overlap the semiconductor layer SP.

The third insulating layer 30 is disposed on the control electrode CE. The third insulating layer 30 may include an organic material and/or an inorganic material, and may have a single layer structure or a laminated structure including a first layer 31 and a second layer 32. The third insulating layer 30 electrically insulates the control electrode CE from the input and output electrodes IE and OE. In an exemplary embodiment, an upper electrode UE may be disposed on the first layer 31 to overlap the control electrode CE, and the first conductive layer constituting the signal lines SL may be disposed on the first layer 31.

The input and output electrodes IE and OE are disposed on the third insulating layer 30. The input and output electrodes IE and OE may be electrically connected to the semiconductor layer SP through first and second contact holes CH1 and CH2 respectively which are defined or formed in the third insulating layer 30 and the second insulating layer 20. A second conductive layer constituting the signal lines SL may be disposed on a same layer as the input and output electrodes IE and OE.

In an exemplary embodiment of the invention, as shown in FIGS. 6A and 6B, the plurality of transistors TR in the second sub-area SDA2 of the display panel DP may have a top gate structure in which the control electrode CE is disposed on the semiconductor layer SP, but not being limited thereto. In an alternative exemplary embodiment, the plurality of transistors TR in the second sub-area SDA2 may have a bottom gate structure in which the control electrode CE is disposed below the semiconductor layer SP. Alternatively, in the second sub-area SDA2, some of the plurality of transistors TR may have the top gate structure, and the remaining transistors may have the bottom gate structure.

The fourth insulating layer 40 is disposed on the input and output electrodes IE and OE. The fourth insulating layer 40 may provide a flat surface. The fourth insulating layer 40 may include an organic material. The organic material may include at least one of acrylic resin, methacrylic resin, polyisoprene, vinyl resin, epoxy resin, urethane resin, cellulose resin, siloxane resin, polyimide resin, polyamide resin, and perylene resin, for example.

A display element OLED may be provided for each of the plurality of sub-pixels and may be connected to a corresponding sub-pixel circuit or corresponding signal lines SL. In an exemplary embodiment of the invention, the display element OLED may be an organic light emitting diode. The display element OLED includes a first electrode E1, the light emitting layer EL, and a second electrode E2.

The first electrode E1 may be connected to the transistor TR through the fourth insulating layer 40. Although not illustrated, a separate connection electrode disposed between the first electrode E1 and the transistor TR may further be included in the second sub-area SDA2 of the display panel DP, and the first electrode E1 may be electrically connected to the transistor TR via the connection electrode.

The fifth insulating layer 50 is disposed on the fourth insulating layer 40. The fifth insulating layer 50 may include an organic material and/or an inorganic material, and may have a single layer structure or a laminated structure. An opening may be defined in the fifth insulating layer 50. The opening may be provided in plural. The opening exposes at least a portion of the first electrode E1. The fifth insulating layer 50 may be a pixel defining film.

The light emitting layer EL is disposed between the first electrode E1 and the second electrode E2. The light emitting layer EL may include at least one emitting layer. In one exemplary embodiment, for example, the light emitting layer EL may be composed of at least one of materials that emit red, green and blue light, and may include a fluorescent material or a phosphorescent material. The light emitting layer EL may include an organic light emitting material or an inorganic light emitting material. The light emitting layer EL may emit light in response to a potential difference between the first electrode E1 and the second electrode E2.

In such an embodiment, the light emitting layer EL may be a layer having an integral shape overlapping the plurality of openings. However, this is merely exemplary, and the light emitting layer EL may include a plurality of patterns respectively corresponding to the openings, but not being limited thereto.

In an exemplary embodiment, the light emitting layer EL may further include a charge control layer in addition to the emitting layer. The charge control layer controls the movement of charges to improve the luminous efficiency and lifetime of the display element OLED. In such an embodiment, the light emitting layer EL may include at least one of a hole transport material, a hole injection material, an electron transport material, and an electron injection material.

The second electrode E2 is disposed on the light emitting layer EL. The second electrode E2 may be opposed to the first electrode E1. The plurality of pixels may include the second electrode E2 in common. The display element OLED disposed in each of the pixels receives a common power supply voltage through the second electrode E2.

The second electrode E2 may include a transmissive conductive material or a transflective conductive material. Accordingly, light generated in the light emitting layer EL may be easily emitted in the third direction DR3 through the second electrode E2. However, this is merely exemplary, and alternatively, the display element OLED may be driven, according to a design, in a bottom emission method in which light is emitted toward the first electrode E1 including a transmissive material or a transflective material or in a double-sided emission method in which light is emitted toward both a front surface and a rear surface, but not being limited thereto.

The encapsulation layer 60 is disposed on the display element OLED to seal the display element OLED. In an exemplary embodiment, although not illustrated, a capping layer for covering the second electrode E2 may further be disposed between the second electrode E2 and the encapsulation layer 60. The encapsulation layer 60 may include at least one inorganic layer and at least one organic layer sequentially or alternately laminated in the third direction DR3.

In an exemplary embodiment, as illustrated in FIGS. 5 and 6A, the non-light emitting area NEA is defined between the light emitting area EA and the transmitting area TA, and the fifth insulating layer 50, which is the pixel defining film, is located in the non-light emitting area NEA.

In an exemplary embodiment, as illustrated in FIG. 6A, the light emitting layer EL and the second electrode E2 may be disposed to overlap the transmitting area TA. In such an embodiment, the second electrode E2 is a transmissive or transflective electrode, such that a transmitting area TA having a higher transmittance than an area in which the sub-pixels are disposed may be effectively provided.

In an alternative exemplary embodiment, as illustrated in FIG. 6B, the first electrode E1, the light emitting layer EL, and the second electrode E2 may not overlap the transmitting area TA. In such an embodiment, the first electrode E1, the light emitting layer EL, and the second electrode E2 may have a structure in which the first electrode E1, the light emitting layer EL and the second electrode E2 are not provided in the transmitting area TA. In such an embodiment, the second electrode E2 among the first electrode E1, the light emitting layer EL, and the second electrode E2 may have a relatively low light transmittance, and the transmittance of the second sub-area SDA2 of the display panel DP may be improved due to removal of the first electrode E1, the light emitting layer EL, and the second electrode E2 from the transmitting area TA.

In another alternative exemplary embodiment, the light emitting layer EL may be disposed to overlap the transmitting area TA, and the second electrode E2 may not overlap the transmitting area TA.

Figure 7:
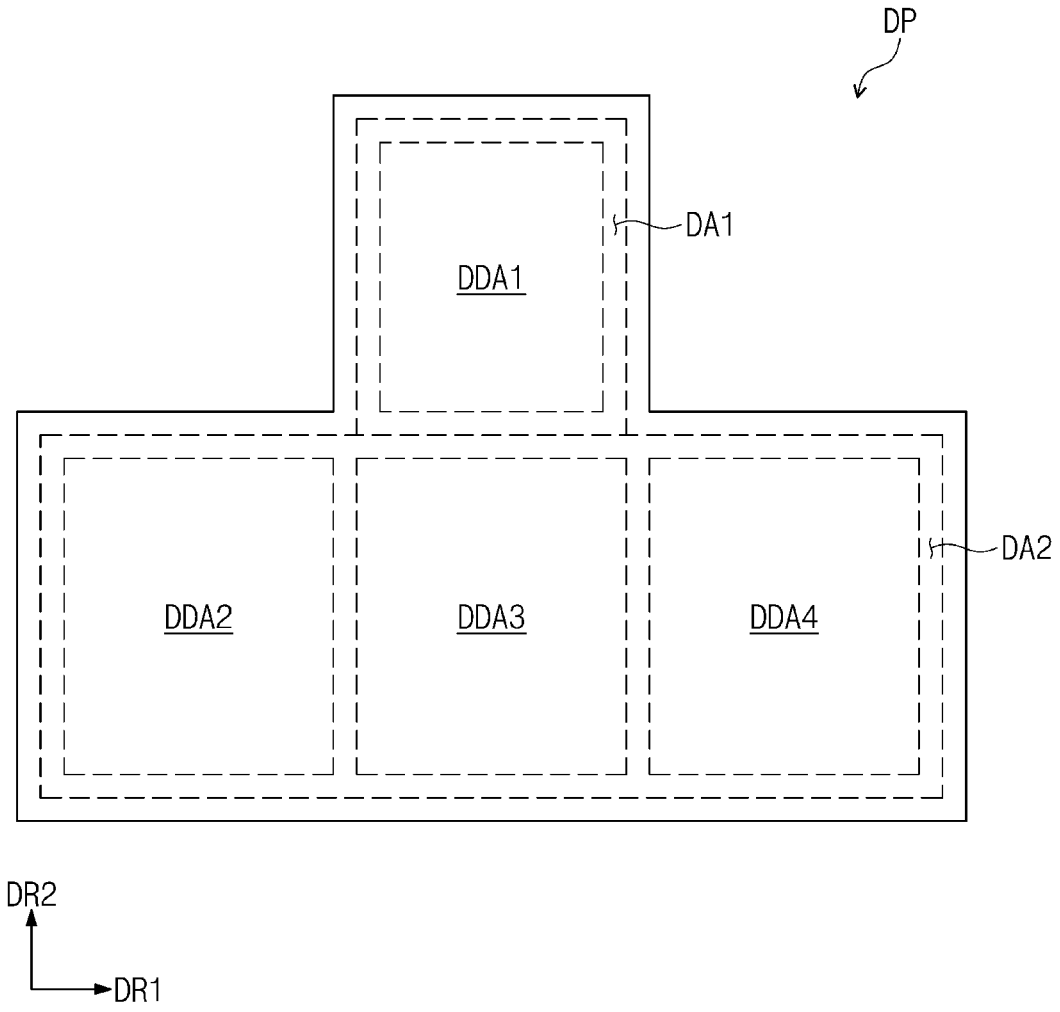
FIG. 7 is a plan view illustrating driving areas of the display panel according to an exemplary embodiment of the invention.

FIG. 7 is a plan view illustrating driving areas of the display panel according to an exemplary embodiment of the invention.

Referring to FIG. 7, in an exemplary embodiment, the first display area DA1 includes a first driving area DDA1, and the second display area DA2 includes a second driving area DDA2, a third driving area DDA3, and a fourth driving area DDA4. In an exemplary embodiment, as shown in FIG. 7, the first display area DA1 includes a single driving area DDA1 and the second display area DA2 includes the three driving areas DDA2 to DDA4, but embodiments of the invention are not limited thereto. Alternatively, the first display area DA1 may include two or more driving areas, and the second display area DA2 may include one or more driving areas. In an exemplary embodiment, the first to fourth driving areas DDA1 to DDA4 are not limited to those shown in FIG. 7, and the size and the shape of the first to fourth driving areas DDA1 to DDA4 may be variously modified.

Figure 8:
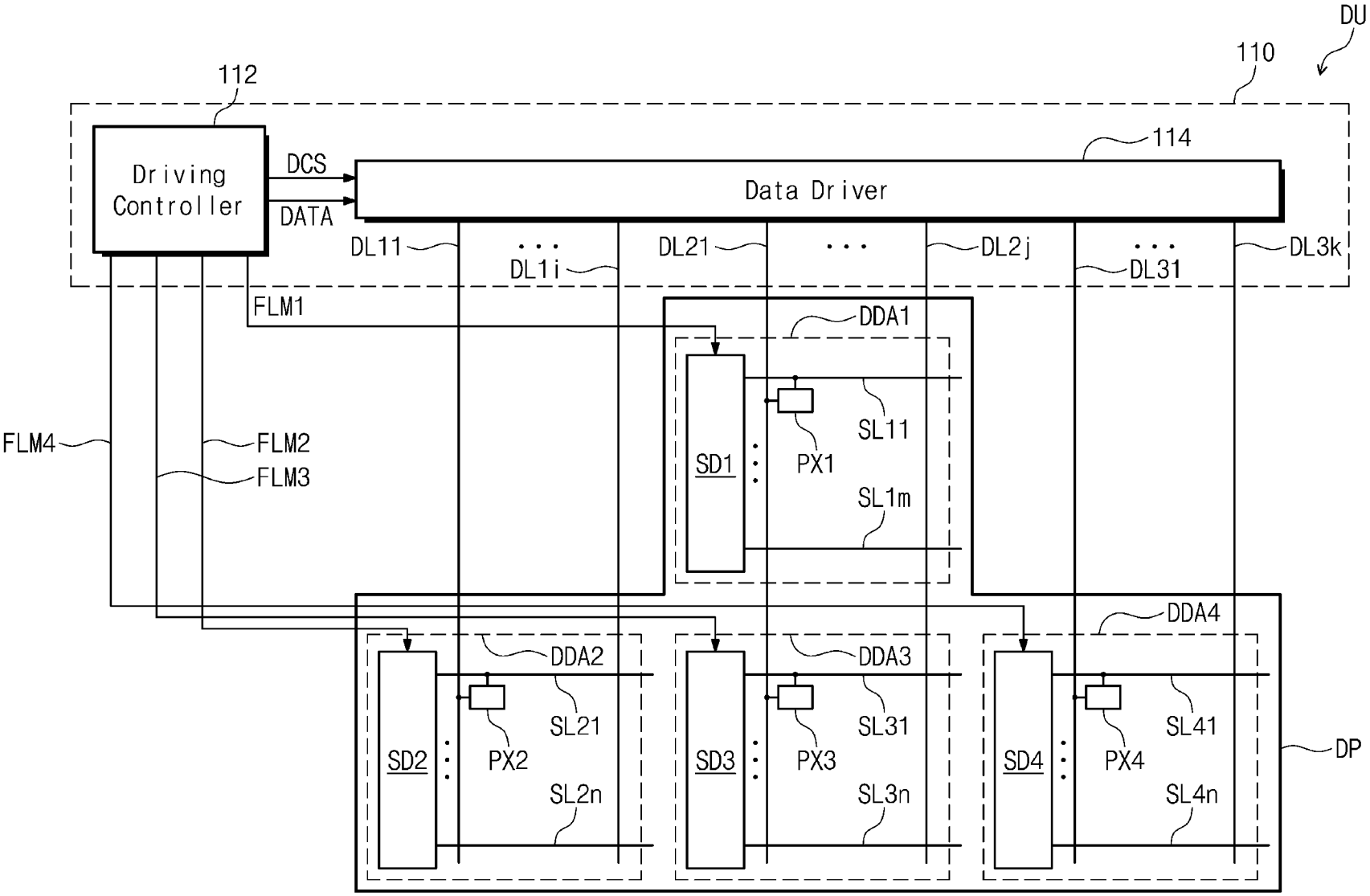
FIG. 8 is a block diagram illustrating a display unit including the display panel and a driving circuit according to an exemplary embodiment of the invention.

FIG. 8 is a block diagram illustrating the display unit including the display panel and the driving circuit according to an exemplary embodiment of the invention.

Referring to FIG. 8, the display unit DU includes a driving circuit 110 and the display panel DP. In an exemplary embodiment, the driving circuit 110 may be implemented as a single chip or a plurality of chips and may be mounted on the main board MB as illustrated in FIG. 1B. The driving circuit 110 includes a driving controller 112 and a data driver 114. The driving controller 112 provides a data control signal DCS and a data signal DATA to the data driver 114 and provides first to fourth scan control signals FLM1 to FLM4 to the display panel DP. The driving controller 112 may further provide the display panel DP with other signals (for example, at least one clock signal) in addition to the first to fourth scan control signals FLM1 to FLM4.

The data driver 114 drives first data lines DL11 to DL1*i*, second data lines DL21 to DL2*j*, and third data lines DL31 to DL3*k* (where i, j, and k are positive integers) in response to the data control signal DCS and the data signal DATA.

The display panel DP includes the first to fourth driving areas DDA1 to DDA4.

The first driving area DDA1 includes a first scan driver SD1 and first pixels PX1. The first pixels PX1 are connected to the second data lines DL21 to DL2*j* and first scan lines SL11 to SL1*m*. The first scan driver SD1 drives the first scan lines SL11 to SL1*m* (where m is a positive integer) in response to the first scan control signal FLM1.

The second driving area DDA2 includes a second scan driver SD2 and second pixels PX2. The second pixels PX2 are connected to the first data lines DL11 to DL1*i* and second scan lines SL21 to SL2*n*. The second scan driver SD2 drives the second scan lines SL21 to SL2*n* (where n is a positive integer) in response to the second scan control signal FLM2.

The third driving area DDA3 includes a third scan driver SD3 and third pixels PX3. The third pixels PX3 are connected to the second data lines DL21 to DL2*j* and third scan lines SL31 to SL3*n*. The third scan driver SD3 drives the third scan lines SL31 to SL3*n* in response to the third scan control signal FLM3.

The fourth driving area DDA4 includes a fourth scan driver SD4 and fourth pixels PX4. The fourth pixels PX4 are connected to the third data lines DL31 to DL3*k* and fourth scan lines SL41 to SL4*n*. The fourth scan driver SD4 drives the fourth scan lines SL41 to SL4*n* in response to the fourth scan control signal FLM4.

In such an embodiment, as described above, the first to fourth scan drivers SD1 to SD4 are provided in the first to fourth driving areas DDA1 to DDA4, respectively, such that the first to fourth driving areas DDA1 to DDA4 may be driven independently of each other.

In one exemplary embodiment, for example, when the driving controller 112 activates the first scan control signal FLM1 and deactivates the second to fourth scan control signals FLM2 to FLM4, only the first scan driver SD1 may operate and thus an image may be displayed only in the first driving area DDA1.

Figure 9A:
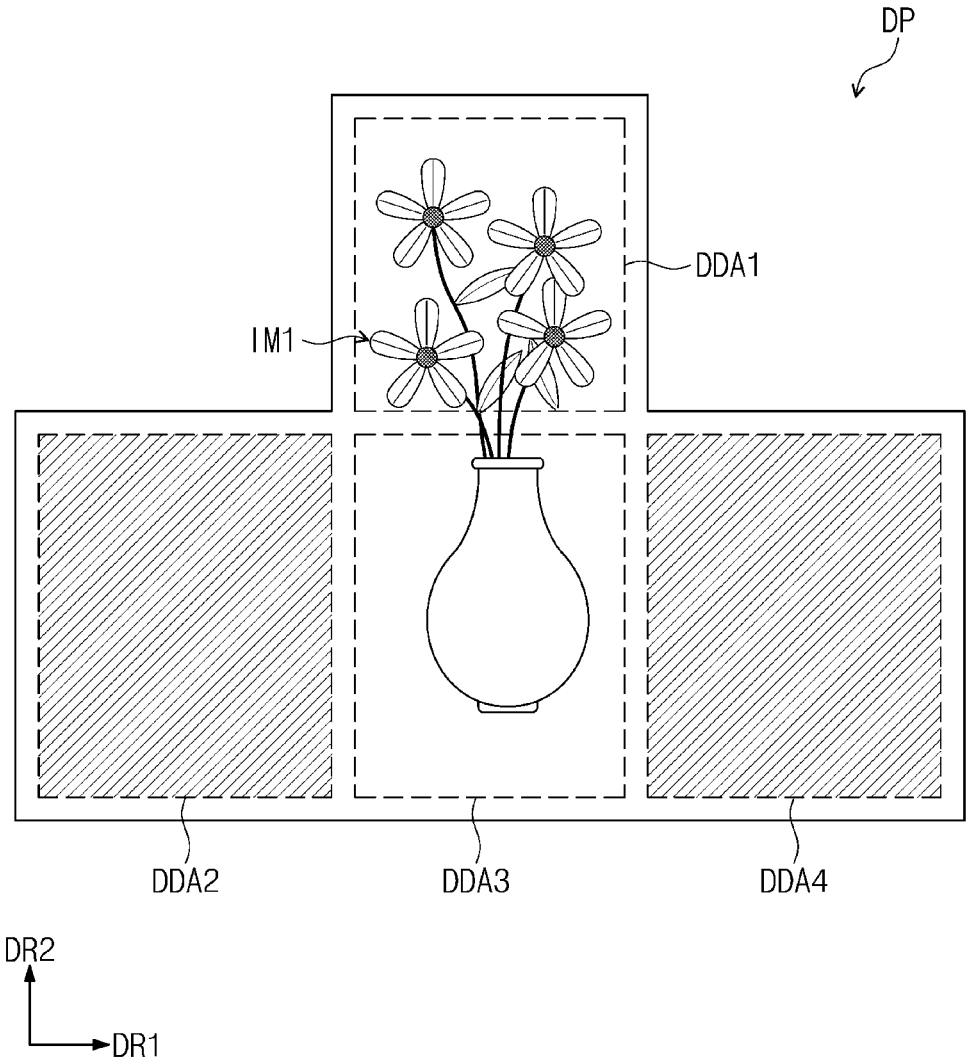
FIG. 9A is a view for describing an operation of the display panel according to an exemplary embodiment of the invention.
Figure 9B:
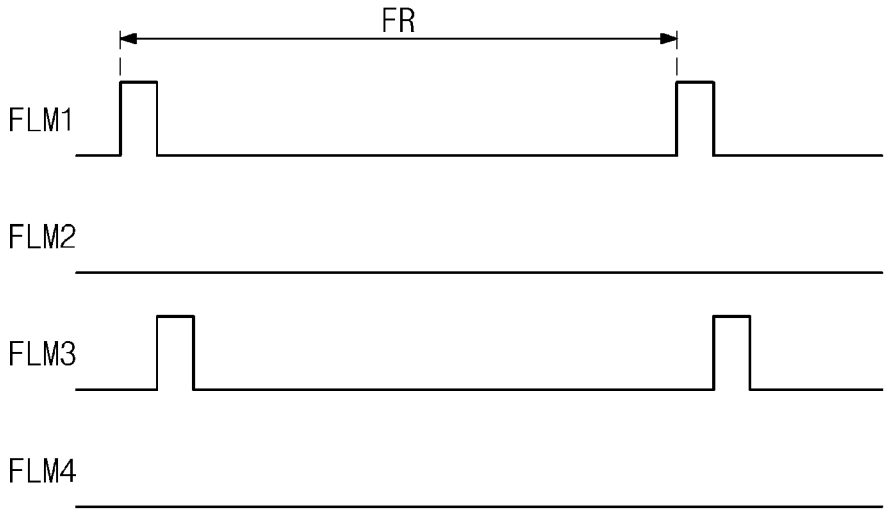
FIG. 9B is a signal timing diagram for describing the operation of the display panel according to an exemplary embodiment of the invention.

FIG. 9A is a view for describing an operation of the display panel according to an exemplary embodiment of the invention. FIG. 9B is a signal timing diagram for describing the operation of the display panel according to an exemplary embodiment of the invention.

In FIG. 9A, an image IM1 is displayed in the first driving area DDA1 and the third driving area DDA3 among the first to fourth driving areas DDA1 to DDA4 of the display panel DP, and the second driving area DDA2 and the fourth driving area DDA4 are maintained in an off state.

Referring to FIGS. 8, 9A, and 9B, the driving controller 112 activates the first scan control signal FLM1 and the third scan control signal FLM3, and deactivates the second scan control signal FLM2 and the fourth scan control signal FLM4. In such an embodiment, the driving controller 112 provides the data driver 114 with a data signal DATA and a data control signal DCS corresponding to the image IM1 to be displayed in the first and third driving areas DDA1 and DDA3.

The first scan driver SD1 and the third scan driver SD3 respectively drive the first scan lines SL11 to SL1*m* and the third scan lines SL31 to SL3*n* in response to the first scan control signal FLM1 and the third scan control signal FLM3. The data driver 114 drives the second data lines DL21 to DL2*j* in response to the data signal DATA and the data control signal DCS.

In such an embodiment, as illustrated in FIG. 9B, the first to fourth scan control signals FLM1 to FLM4 may each be a signal indicating the start of one frame FR. In an exemplary embodiment, the first scan control signal FLM1 and the third scan control signal FLM3 may sequentially transition to an active level (for example, a high level) so that the first driving area DDA1 and the third driving area DDA3 are sequentially driven.

In an exemplary embodiment, the second scan control signal FLM2 and the fourth scan control signal FLM4 may be maintained in an inactive level (for example, a low level) so that the second driving area DDA2 and the fourth driving area DDA4 are kept in an off state.

Figure 10A:
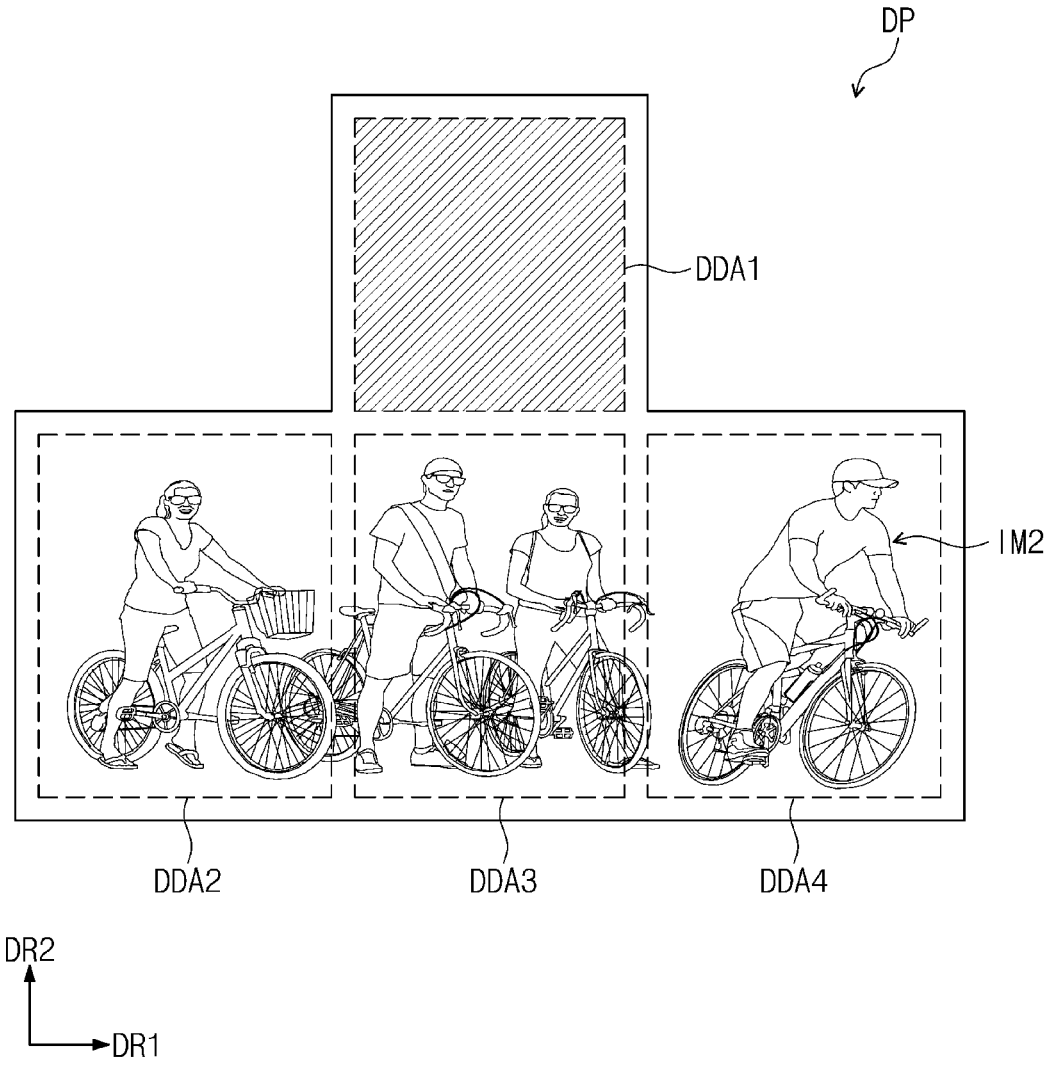
FIG. 10A is a view for describing an operation of the display panel according to an exemplary embodiment of the invention.
Figure 10B:
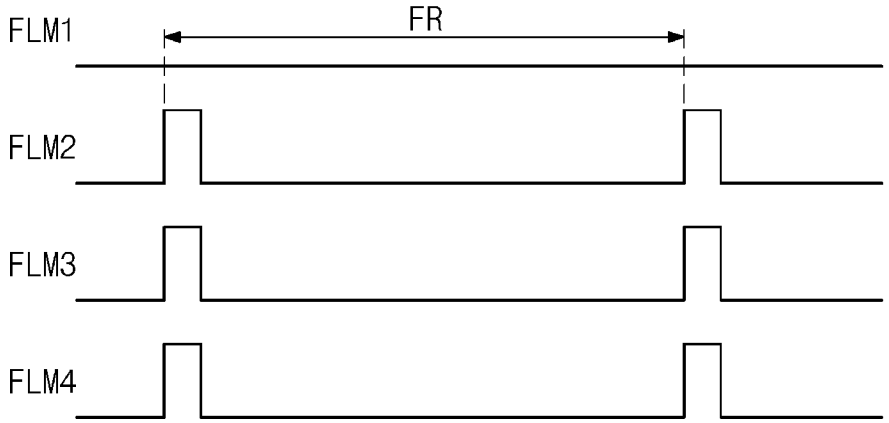
FIG. 10B is a signal timing diagram for describing the operation of the display panel according to an exemplary embodiment of the invention.

FIG. 10A is a view for describing an operation of the display panel according to an exemplary embodiment of the invention. FIG. 10B is a signal timing diagram for describing the operation of the display panel according to an exemplary embodiment of the invention.

In FIG. 10A, an image IM2 is displayed in the second to fourth driving areas DDA2 to DDA4 among the first to fourth driving areas DDA1 to DDA4 of the display panel DP, and the first driving area DDA1 is maintained in an off state.

Referring to FIGS. 8, 10A, and 10B, the driving controller 112 activates the second scan control signal FLM2, the third scan control signal FLM3, and the fourth scan control signal FLM4, and deactivates the first scan control signal FLM1. In such an embodiment, the driving controller 112 provides the data driver 114 with a data signal DATA and a data control signal DCS corresponding to the image IM2 to be displayed in the second to fourth driving areas DDA2 to DDA4.

The second scan driver SD2, the third scan driver SD3, and the fourth scan driver SD4 respectively drive the second scan lines SL21 to SL2*n*, the third scan lines SL31 to SL3*n*, and the fourth scan lines SL41 to SL4*n* in response to the second scan control signal FLM2, the third scan control signal FLM3, and the fourth scan control signal FLM4. The data driver 114 drives the first data lines DL11 to DL1*i*, the second data lines DL21 to DL2*j*, and the third data lines DL31 to DL3*k* in response to the data signal DATA and the data control signal DCS.

In an exemplary embodiment, as illustrated in FIG. 10B, the first to fourth scan control signals FLM1 to FLM4 may each be a signal indicating the start of the one frame FR. In an exemplary embodiment, the second scan control signal FLM2, the third scan control signal FLM3, and the fourth scan control signal FLM4 may simultaneously transition to the active level (for example, the high level) so that the second driving area DDA2, the third driving area DDA3, and the fourth driving area DDA4 are simultaneously driven.

In an exemplary embodiment, the first scan control signal FLM1 may be maintained in the inactive level (for example, the low level) so that the first driving area DDA1 is maintained in an off state.

Figure 11:
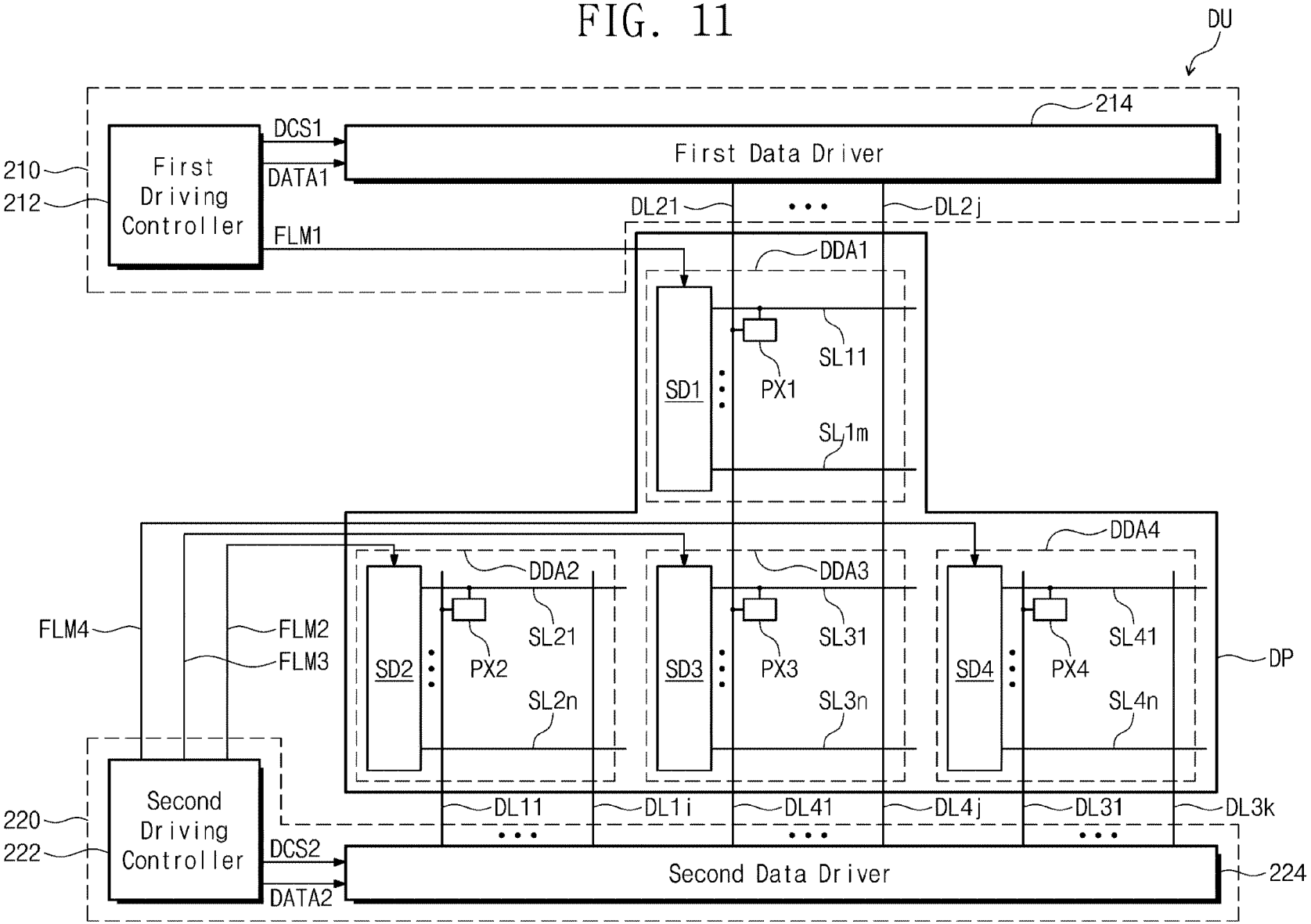
FIG. 11 is a block diagram exemplarily illustrating a display unit including a display panel and a driving circuit according to an exemplary embodiment of the invention.

FIG. 11 is a block diagram illustrating a display unit including a display panel and a driving circuit according to an exemplary embodiment of the invention.

Referring to FIG. 11, an exemplary embodiment of a display unit DU includes a first driving circuit 210, a second driving circuit 220, and a display panel DP.

The first driving circuit 210 includes a first driving controller 212 and a first data driver 214. The first driving controller 212 provides a first data control signal DCS1 and a first data signal DATA1 to the first data driver 214 and provides the first scan control signal FLM1 to the display panel DP. The first driving controller 212 may further provide the display panel DP with other signals (for example, at least one clock signal) in addition to the first scan control signal FLM1.

The first data driver 214 drives the second data lines DL21 to DL2*j* in response to the first data control signal DCS1 and the first data signal DATA1.

The second driving circuit 220 includes a second driving controller 222 and a second data driver 224. The second driving controller 222 provides a second data control signal DCS2 and a second data signal DATA2 to the second data driver 224 and provides the second to fourth scan control signals FLM2 to FLM4 to the display panel DP. The second driving controller 222 may further provide the display panel DP with other signals (for example, at least one clock signal) in addition to the second to fourth scan control signals FLM2 to FLM4.

The second data driver 224 drives the first data lines DL11 to DL1*i*, the third data lines DL31 to DL3*k*, and fourth data lines DL41 to DL4*j* in response to the second data control signal DCS2 and the second data signal DATA2.

The display panel DP includes the first to fourth driving areas DDA1 to DDA4.

The first driving area DDA1 includes the first scan driver SD1 and the first pixels PX1. The first pixels PX1 are connected to the second data lines DL21 to DL2*j* and the first scan lines SL11 to SL1*m*. The first scan driver SD1 drives the first scan lines SL11 to SL1*m* in response to the first scan control signal FLM1.

The second driving area DDA2 includes the second scan driver SD2 and the second pixels PX2. The second pixels PX2 are connected to the first data lines DL11 to DL1*i* and the second scan lines SL21 to SL2*n*. The second scan driver SD2 drives the second scan lines SL21 to SL2*n* in response to the second scan control signal FLM2.

The third driving area DDA3 includes the third scan driver SD3 and the third pixels PX3. The third pixels PX3 are connected to the fourth data lines DL41 to DL4*j* and the third scan lines SL31 to SL3*n*. The third scan driver SD3 drives the third scan lines SL31 to SL3*n* in response to the third scan control signal FLM3.

The fourth driving area DDA4 includes the fourth scan driver SD4 and the fourth pixels PX4. The fourth pixels PX4 are connected to the third data lines DL31 to DL3*k* and the fourth scan lines SL41 to SL4*n*. The fourth scan driver SD4 drives the fourth scan lines SL41 to SL4*n* in response to the fourth scan control signal FLM4.

In an exemplary embodiment, as described above, the first to fourth scan drivers SD1 to SD4 are disposed in the first to fourth driving areas DDA1 to DDA4, respectively, so that the first to fourth driving areas DDA1 to DDA4 may be driven independently of each other.

In one exemplary embodiment, for example, when the first driving controller 212 activates the first scan control signal FLM1 and the second driving controller 222 deactivates the second to fourth scan control signals FLM2 to FLM4, only the first scan driver SD1 may operate and thus an image may be displayed only in the first driving area DDA1.

Figure 12A:
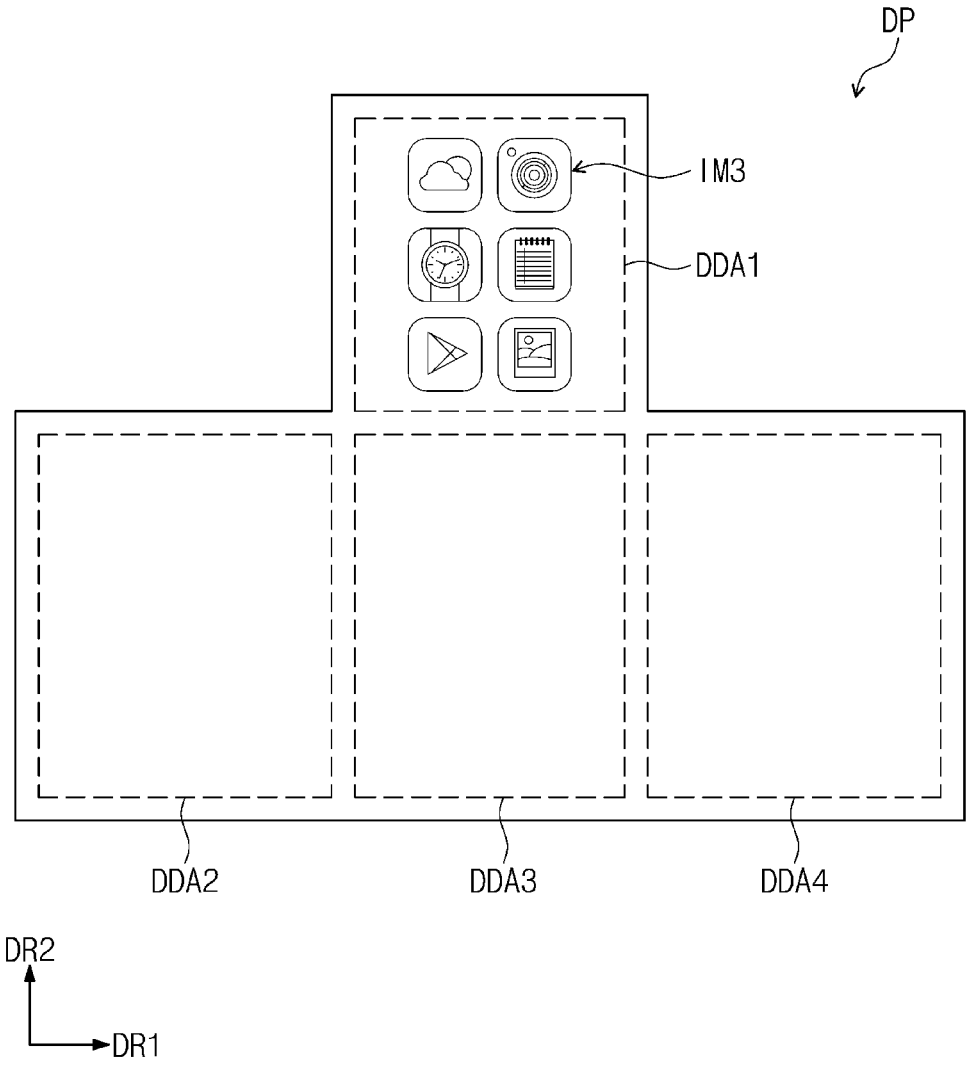
FIG. 12A is a view for describing an operation of the display panel according to an exemplary embodiment of the invention.
Figure 12B:
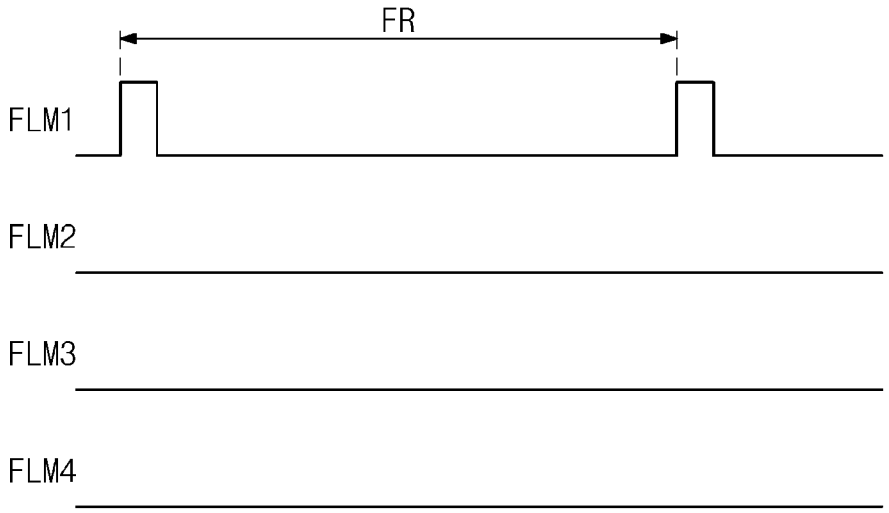
FIG. 12B is a signal timing diagram for describing the operation of the display panel according to an exemplary embodiment of the invention.

FIG. 12A is a view for describing an operation of the display panel according to an exemplary embodiment of the invention. FIG. 12B is a signal timing diagram for describing the operation of the display panel according to an exemplary embodiment of the invention.

In FIG. 12A, an image IM3 is displayed in the first driving area DDA1 among the first to fourth driving areas DDA1 to DDA4 of the display panel DP, and the second to fourth driving areas DDA2 to DDA4 are kept in an off state.

Referring to FIGS. 11, 12A, and 12B, the first driving controller 212 activates the first scan control signal FLM1, and provides the first data driver 214 with a first data signal DATA1 and a first data control signal DCS1 corresponding to the image IM3 to be displayed in the first driving area DDA1.

The second driving controller 222 deactivates the second to fourth scan control signals FLM2 to FLM4. The second driving controller 222 does not provide the second data signal DATA2 and the second data control signal DCS2 to the second data driver 224.

The first scan driver SD1 drives the first scan lines SL11 to SL1*m* in response to the first scan control signal FLM1. The first data driver 214 drives the second data lines DL21 to DL2*j* in response to the first data signal DATA1 and the first data control signal DCS1.

In an exemplary embodiment, as illustrated in FIG. 12B, the first to fourth scan control signals FLM1 to FLM4 may each be a signal indicating the start of the one frame FR. In an exemplary embodiment, the first scan control signal FLM1 may transition to the active level (for example, the high level) every frame so that the first driving area DDA1 is driven.

In an exemplary embodiment, the second scan control signal FLM2, the third scan control signal FLM3, and the fourth scan control signal FLM4 may be maintained in the inactive level (for example, the low level) so that the second driving area DDA2, the third driving area DDA3, and the fourth driving area DDA4 are maintained in an off state.

Figure 13A:
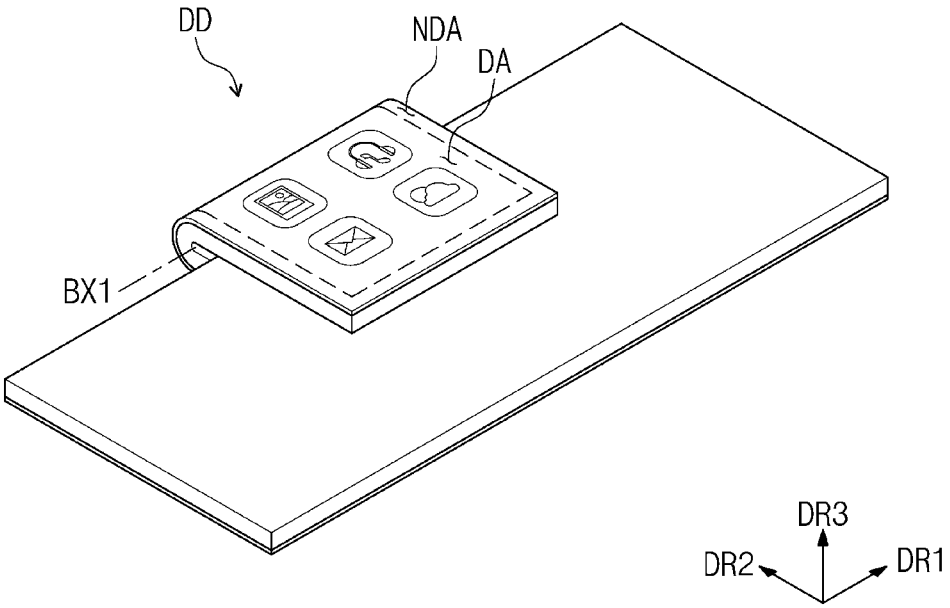
FIGS. 13A and 13B are views illustrating a display device including a display panel of FIG. 3 in a folded state.
Figure 13B:
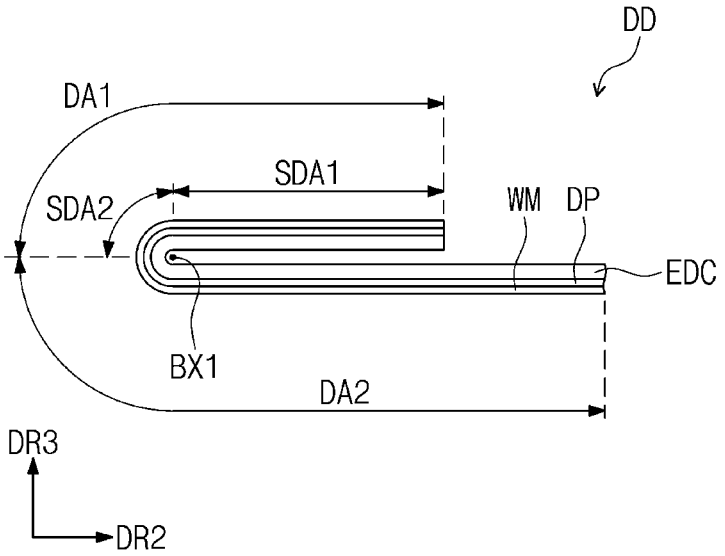

FIGS. 13A and 13B are views illustrating a display device including a display panel of FIG. 3 in a folded state.

Referring to FIGS. 3, 13A, and 13B, at least a portion of a first display area DA1 of a display panel DP may be bent in a display device DD according to an exemplary embodiment of the invention.

A predetermined area of the display device DD corresponding to a second sub-area SDA2 of the display panel DP is flexible and thus the shape thereof may be changed by bending, folding, rolling or the like.

An image may be displayed only in the first display area DA1 of the display panel DP in a first mode in which the display device DD is completely out-folded with respect to a first bending axis BX1. Alternatively, an image may be displayed only in a second display area DA2 of a display panel DP in the first mode.

The first bending axis BX1 may correspond to a position in which the first display area DA1 and a second display area DA2 are adjacent to each other or may be in a boundary area between the first display area DA1 and a second display area DA2.

Figure 14:
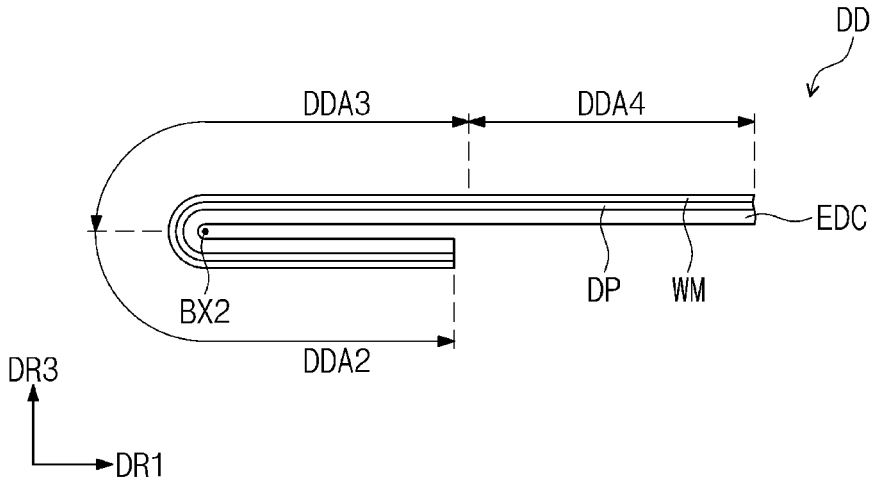
FIG. 14 is a cross-sectional view illustrating the display device including a display panel of FIG. 7 in a folded state.

FIG. 14 is a cross-sectional view illustrating the display device including a display panel of FIG. 7 in a folded state.

Referring to FIGS. 7 and 14, at least a portion of the second display area DA2 of the display panel DP may be bent in the display device DD according to an exemplary embodiment of the invention.

A predetermined area of the display device DD corresponding to the second driving area DDA2 of the display panel DP is flexible and thus the shape thereof may be changed by bending, folding, rolling or the like.

An image may be displayed only in the first driving area DDA1, the third driving area DDA3, and the fourth driving area DDA4 of the display panel DP in a second mode in which the display device DD is completely out-folded with respect to a second bending axis BX2. Alternatively, an image may be displayed only in a second driving area DDA2 of a display panel DP in the second mode.

The second bending axis BX2 may correspond to a position in which the second driving area DDA2 and the third driving area DDA3 are adjacent to each other or may be in a boundary area between the second driving area DDA2 and the third driving area DDA3.

Figure 15:
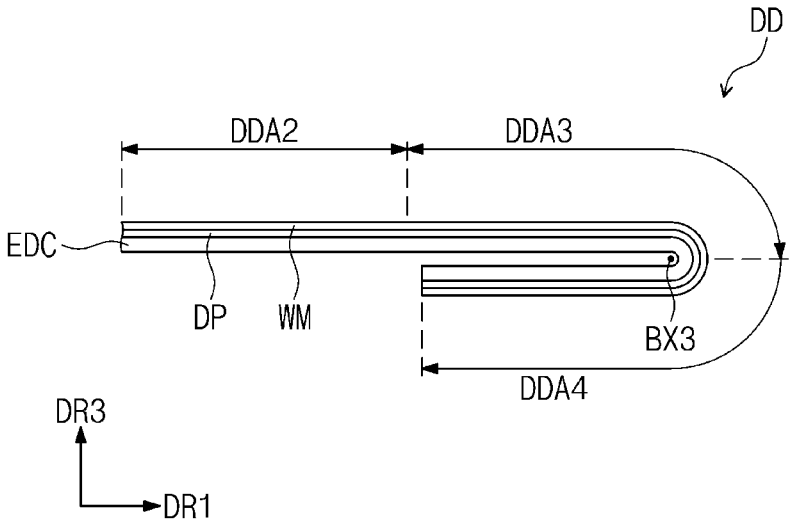
FIG. 15 is a cross-sectional view illustrating the display device including a display panel of FIG. 7 in another folded state.

FIG. 15 is a cross-sectional view illustrating the display device including a display panel of FIG. 7 in another folded state.

Referring to FIGS. 7 and 15, at least a portion of the fourth display driving area DDA4 of the display panel DP may be bent in the display device DD according to an exemplary embodiment of the invention.

A predetermined area of the display device DD corresponding to the fourth driving area DDA4 of the display panel DP is flexible and thus the shape thereof may be changed by bending, folding, rolling or the like.

An image may be displayed only in the first driving area DDA1, the second driving area DDA2, and the third driving area DDA3 of the display panel DP in a third mode in which the display device DD is completely out-folded with respect to a third bending axis BX3. Alternatively, an image may be displayed only in a fourth driving area DDA4 of a display panel DP in the third mode.

The third bending axis BX3 may correspond to a position in which the third driving area DDA3 and the fourth driving area DDA4 are adjacent to each other or may be in a boundary area between the third driving area DDA3 and the fourth driving area DDA4.

Figure 16:
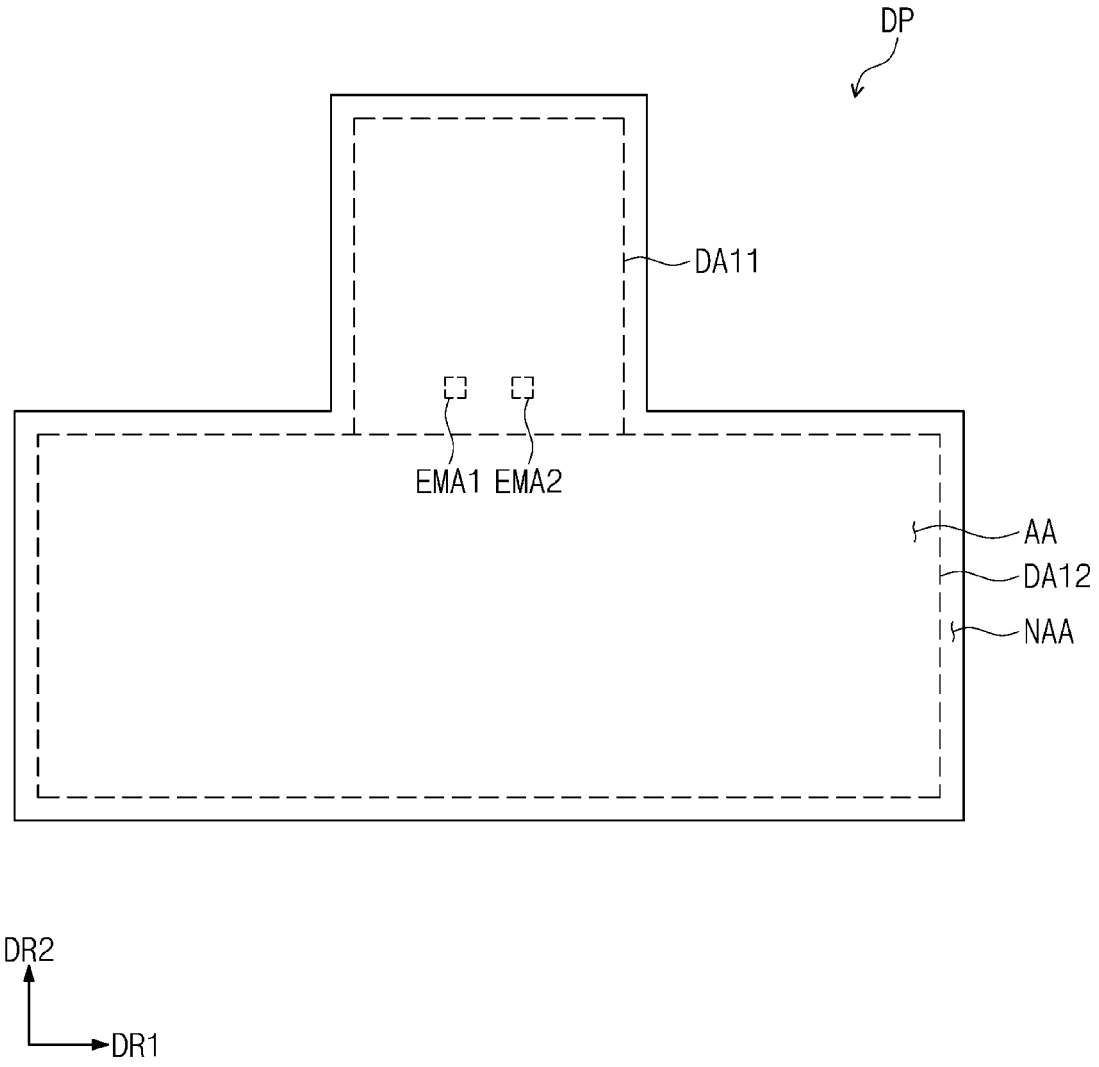
FIG. 16 is a plan view illustrating a display panel according to an exemplary embodiment of the invention.

FIG. 16 is a plan view illustrating a display panel according to an exemplary embodiment of the invention.

Referring to FIG. 16, the display panel DP includes the active area AA and the peripheral area NAA. The active area AA includes a first display area DA11 and a second display area DA12. The first display area DA11 may have a relatively higher light transmittance than the second display area DA12. The first electronic module area EMA1 and the second electronic module area EMA2 may be defined in the first display area DA11. The light emitting module LM and the camera module CMM illustrated in FIG. 1B are arranged in rear surfaces of the first electronic module area EMA1 and the second electronic module area EMA2. The light emitting module LM and the camera module CMM arranged to overlap the first display area DA11 having a high light transmittance may easily detect an external subject or easily provide an outputted optical signal to the outside.

In an exemplary embodiment, the first electronic module area EMA1 and the second electronic module area EMA2 are arranged in the lower area of the first display area DA11, but embodiments of the invention are not limited thereto. The first electronic module area EMA1 and the second electronic module area EMA2 may be disposed at any position within the first display area DA11 because the entirety of the first display area DA11 has a high light transmittance in the display panel DP illustrated in FIG. 16.

Figure 17A:
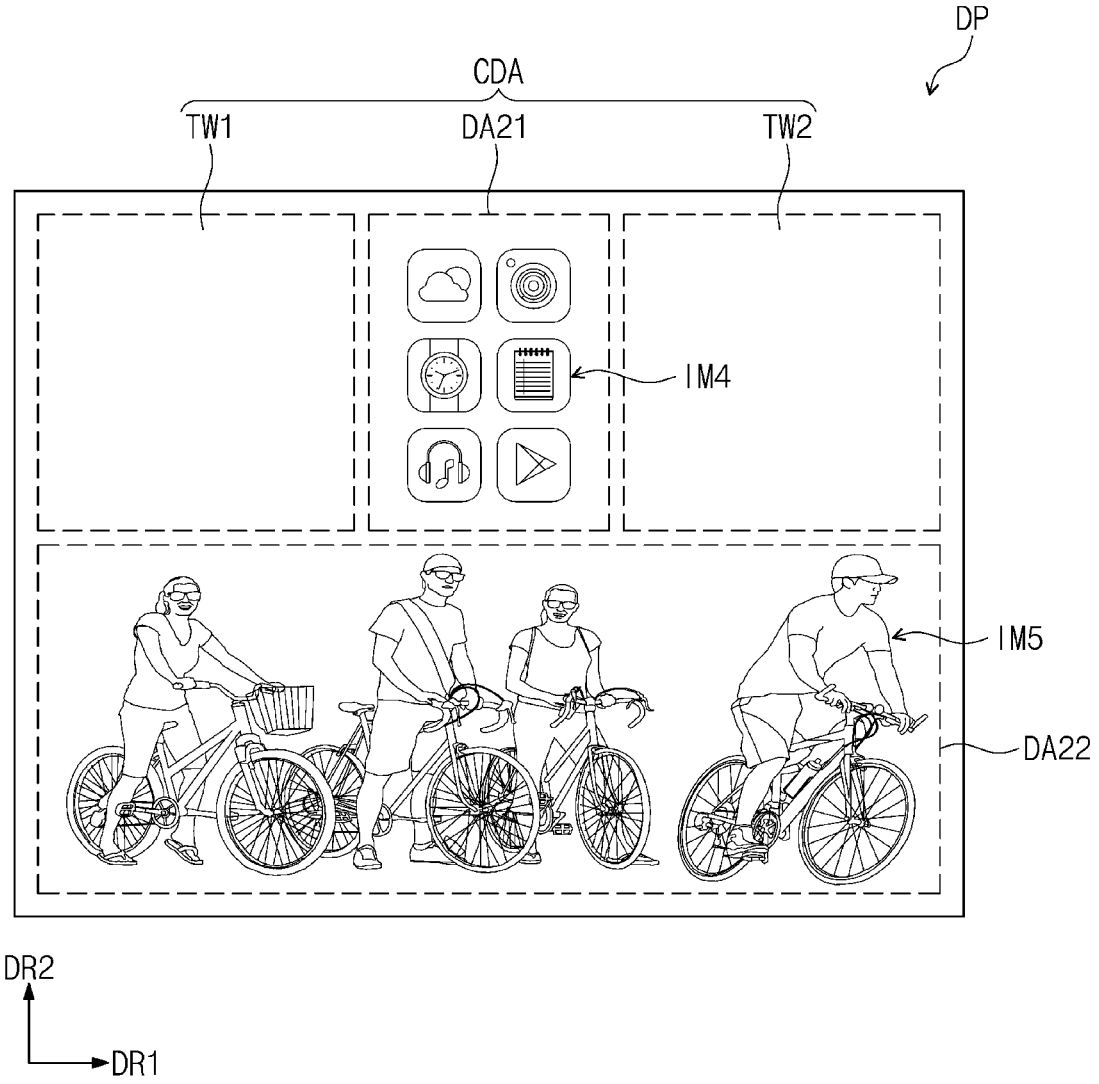
FIG. 17A is a plan view illustrating display areas of a display panel according to an exemplary embodiment of the invention.

FIG. 17A is a plan view illustrating display areas of a display panel according to an exemplary embodiment of the invention.

Referring to FIG. 17A, an exemplary embodiment of a display panel DP has a rectangular shape. The display panel DP includes a composite area CDA and a second display area DA22. The composite area CDA includes a first display area DA21, a first transparent area TW1, and a second transparent area TW2. The first transparent area TW1 and the second transparent area TW2 are arranged to be respectively adjacent to opposing sides of the first display area DA21, but embodiments of the invention are not limited thereto.

In such an embodiment, although not illustrated in the figure, a portion of the first display area DA21 may have a higher light transmittance than the second display area DA22, as illustrated in FIG. 3. A light emitting module LM and a camera module CMM illustrated in FIG. 1B may be arranged in a rear surface of the portion of the first display area DA21 having a high light transmittance.

The first transparent area TW1 and the second transparent area TW2 include only a base substrate BS illustrated in FIG. 6A, and do not include a display element layer DEL. Accordingly, the first transparent area TW1 and the second transparent area TW2 may be substantially transparent. Images are displayed only in the first display area DA21 and the second display area DA22 in the display panel DP of a rectangular shape, and images are not displayed in the first transparent area TW1 and the second transparent area TW2. Accordingly, the display panel DP may be produced in the rectangular shape, but an image may be displayed only in a partial area.

A driving circuit 110 illustrated in FIG. 8 may display an image in at least one of the first display area DA21 and the second display area DA22 depending on an operation mode. In one exemplary embodiment, for example, the driving circuit 110 may display an image IM4 in the first display area DA21 and display an image IM5 in the second display area DA22, during a first mode. In an exemplary embodiment, the image IM4 and the image IM5 may be images that are related to each other. Alternatively, the images IM4 and IM5 may be images that are independent of each other.

Figure 17B:
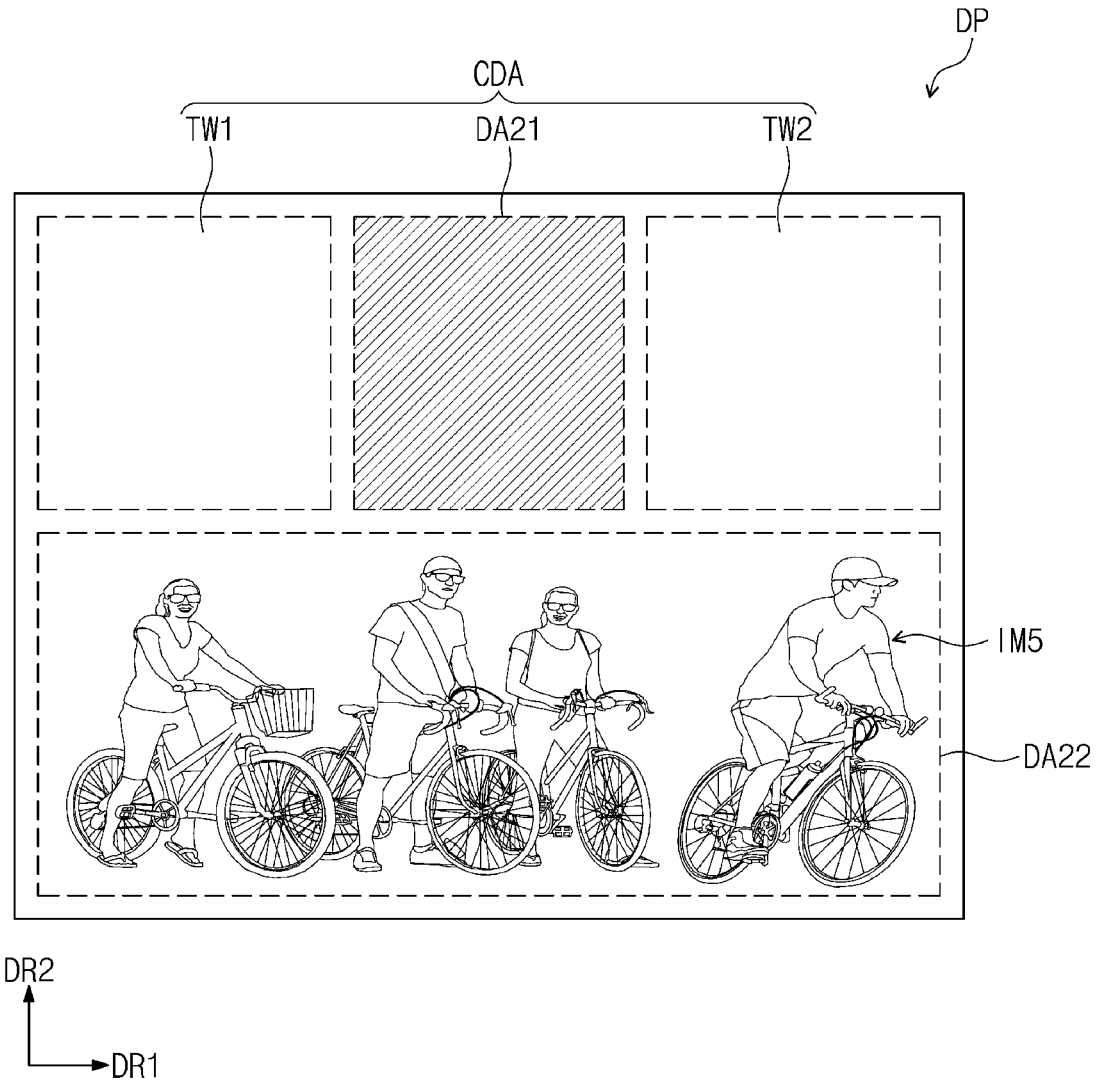
FIG. 17B is a view for describing an operation of the display panel illustrated in FIG. 17A.

FIG. 17B is a view for describing an operation of the display panel illustrated in FIG. 17A.

Referring to FIG. 17B, the driving circuit 110 illustrated in FIG. 8 may display the image IM5 in the second display area DA22 during a second mode. The driving circuit 110 does not display any image in the first display area DA21 during the second mode. Alternatively, a driving circuit 110 may display an image only in a first display area DA21 and may not display an image in a second display area DA22, during the second mode.

Figure 17C:
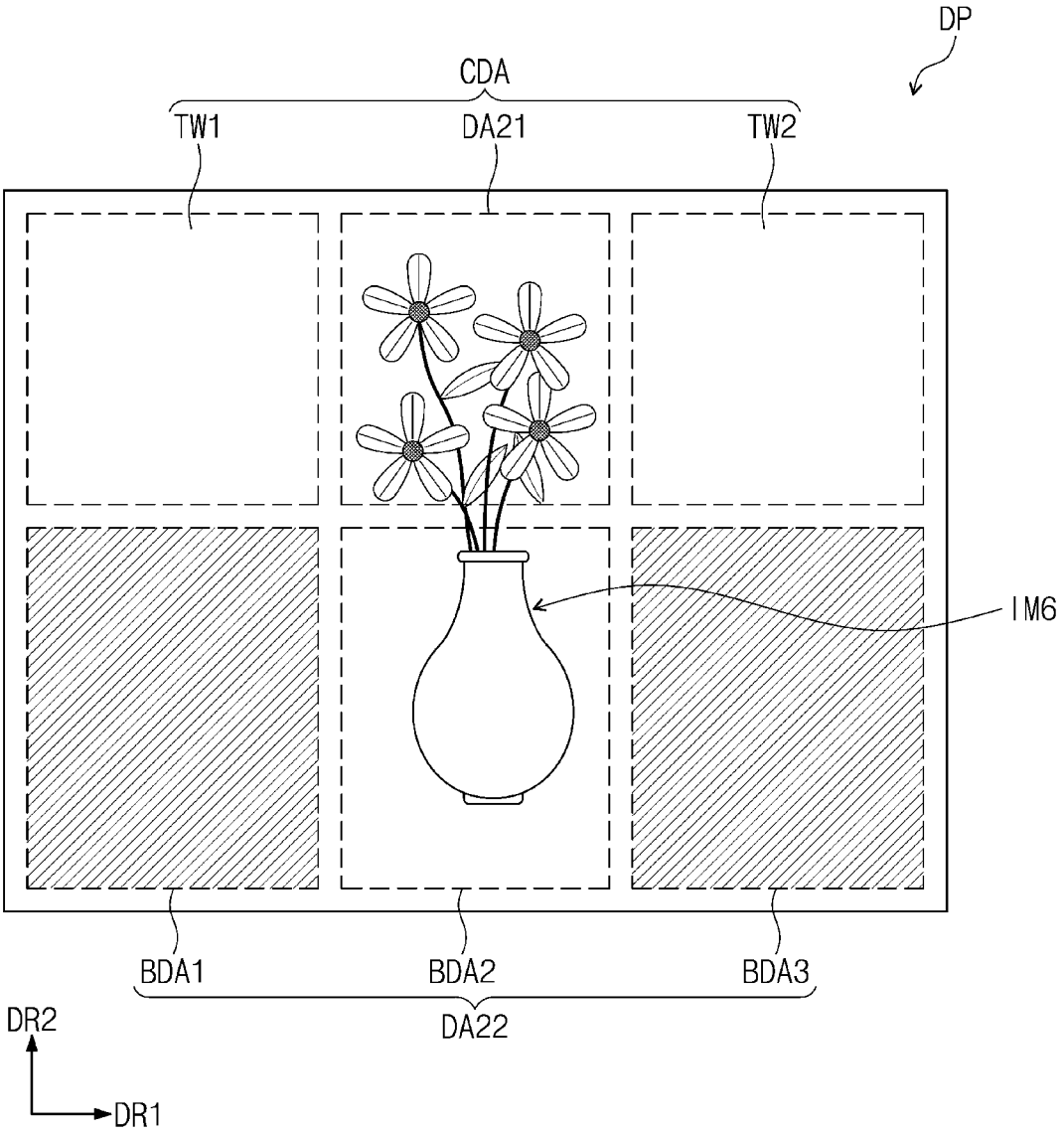
FIG. 17C is a view for describing an operation of the display panel illustrated in FIG. 17A.

FIG. 17C is a view for describing an operation of the display panel illustrated in FIG. 17A.

Referring to FIG. 17C, the second display area DA22 includes a first driving area BDA1, a second driving area BDA2, and a third driving area BDA3. The number of driving areas included in the second display area DA22 may be variously changed.

In an exemplary embodiment, the first transparent area TW1 and the second transparent area TW2 in the composite area CDA are respectively adjacent to the first driving area BDA1 and the third driving area BDA3 in the second display area DA22. The first display area DA21 in the composite area CDA is adjacent to the second driving area BDA2 in the second display area DA22.

The driving circuit 110 illustrated in FIG. 8 may display an image IM6 in the first display area DA21 and the second driving area BDA2 during a third mode. In this case, the first driving area BDA1 and the third driving area BDA3 may be kept in a non-operating state (an off state).

Figure 18A:
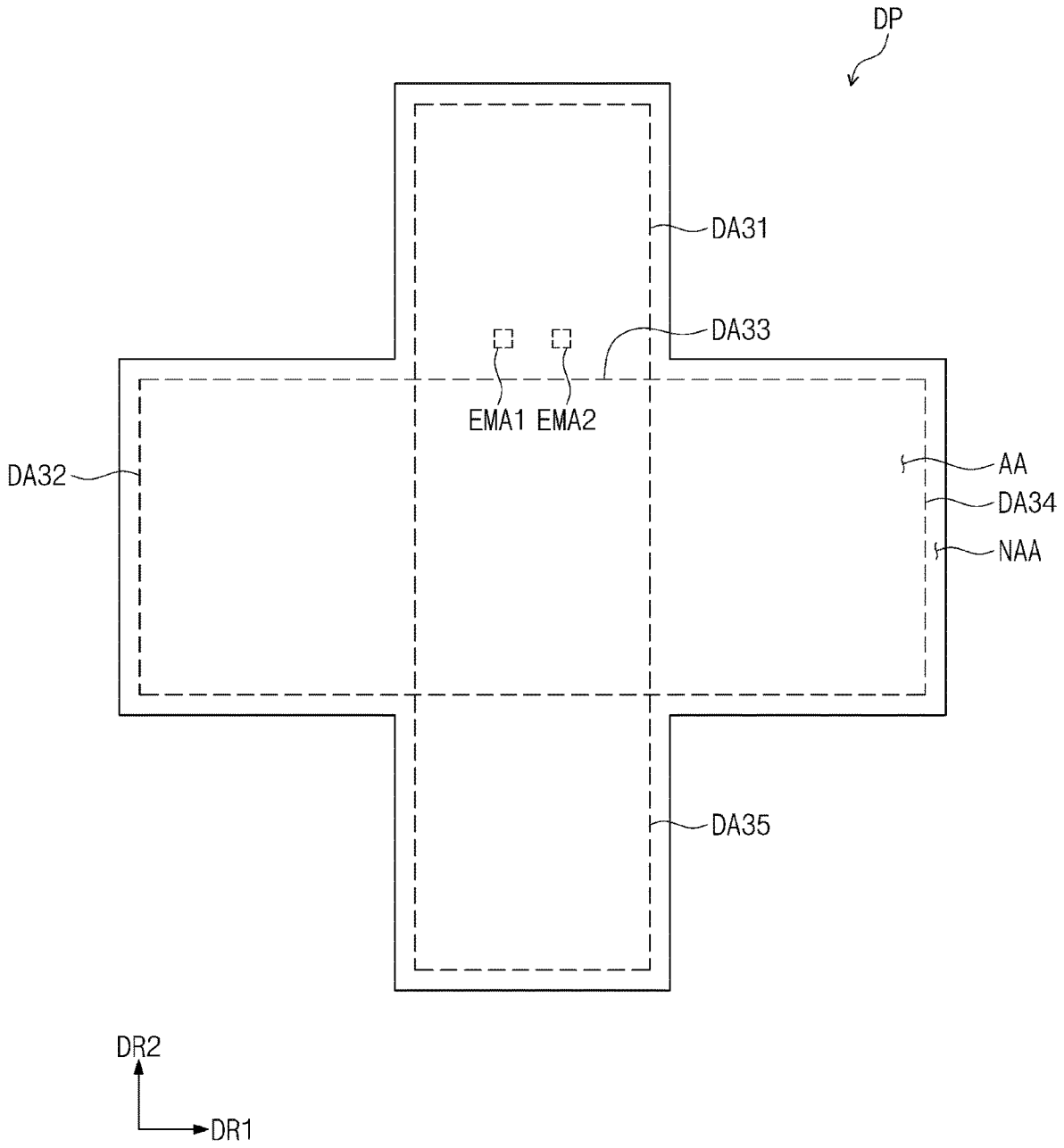
FIGS. 18A to 18C are plan views illustrating exemplary embodiments of a display panel.
Figure 18B:
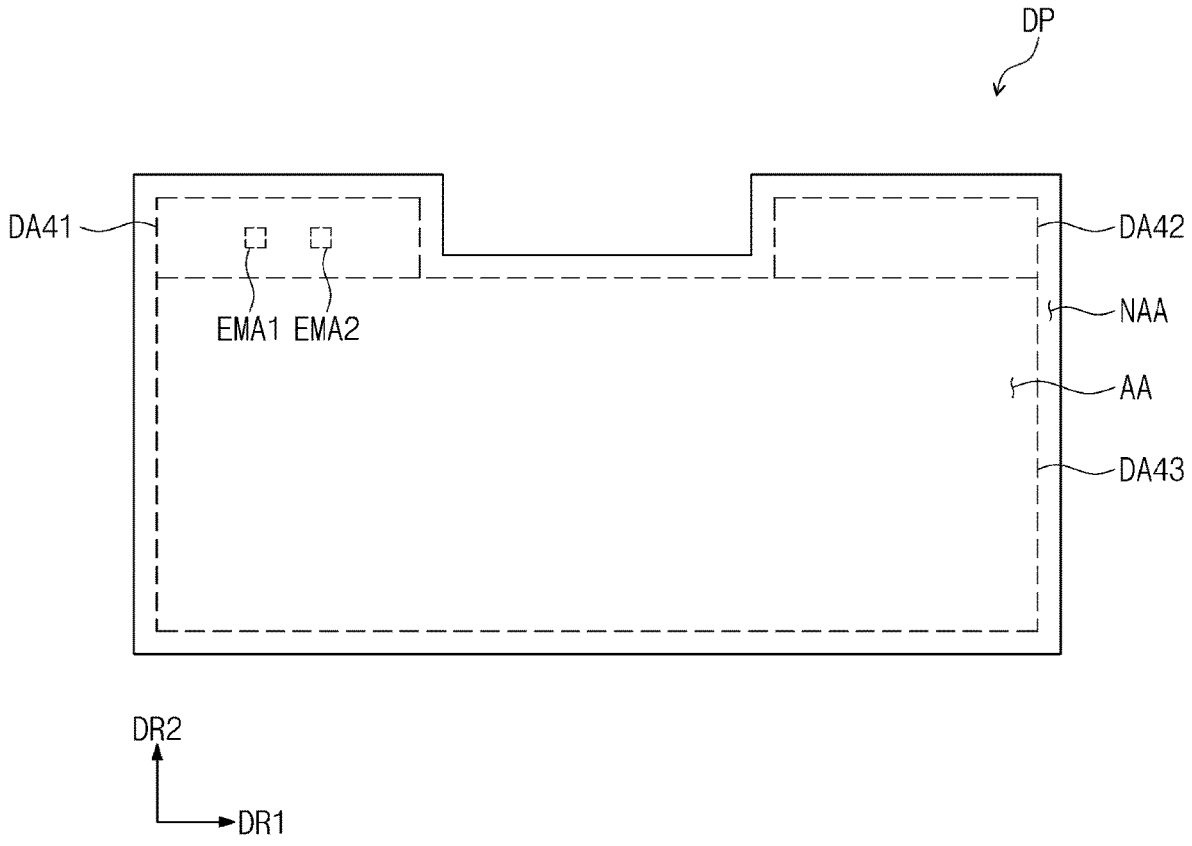
Figure 18C:
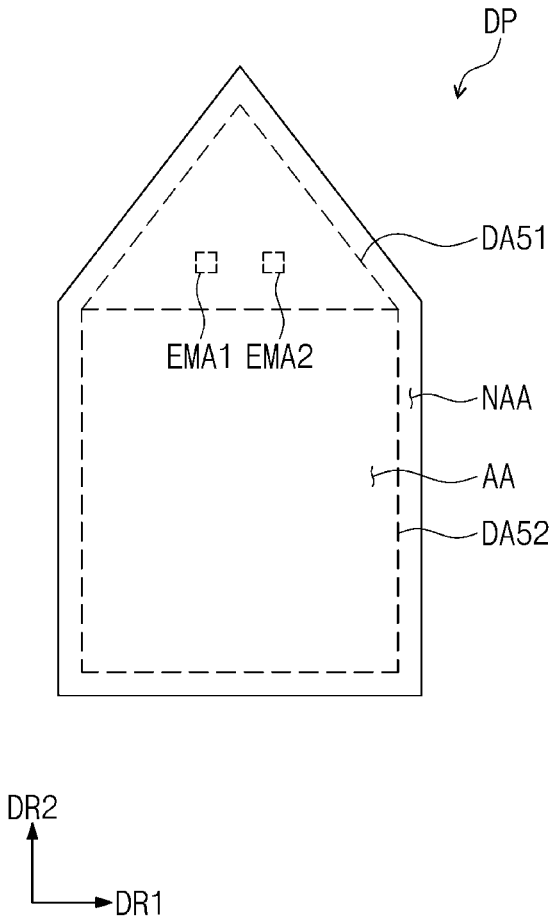
Figure 18D:
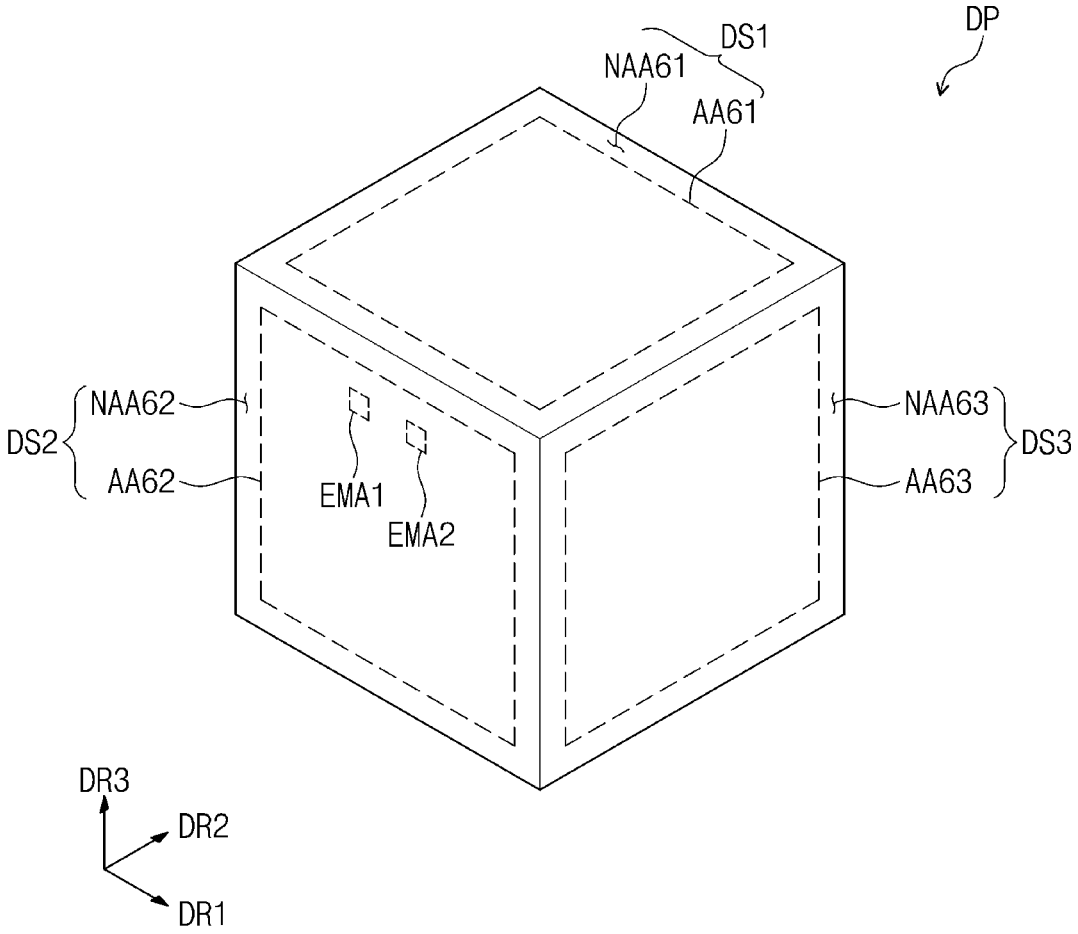
FIG. 18D is a perspective view illustrating exemplary embodiments of a display panel.

FIGS. 18A to 18C are plan views illustrating exemplary embodiments of a display panel, and FIG. 18D is a perspective view illustrating exemplary embodiments of a display panel.

In an exemplary embodiment, as illustrated in FIG. 18A, a display panel DP has a cross shape. The display panel DP includes an active area AA and a peripheral area NAA. The active area AA includes a first display area DA31, a second display area DA32, a third display area DA33, a fourth display area DA34, and fifth display area DA35. The first electronic module area EMA1 and the second electronic module area EMA2 may be defined in a portion of the first display area DA31. The light emitting module LM and the camera module CMM illustrated in FIG. 1B are arranged in rear surfaces of the first electronic module area EMA1 and the second electronic module area EMA2. Alternatively, a first electronic module area EMA1 and a second electronic module area EMA2 may be defined in any one of a second display area DA32, a third display area DA33, a fourth display area DA34 and fifth display area DA35.

In an alternative exemplary embodiment, as illustrated in FIG. 18B, a display panel DP includes an active area AA and a peripheral area NAA. The active area AA includes a first display area DA41, a second display area DA42, and a third display area DA43. The first display area DA41 and the second display area DA42 may be disposed to be spaced apart from each other, on a side of the third display area DA43.

The first electronic module area EMA1 and the second electronic module area EMA2 may be defined in a portion of the first display area DA41. The light emitting module LM and the camera module CMM illustrated in FIG. 1B are arranged in rear surfaces of the first electronic module area EMA1 and the second electronic module area EMA2. Alternatively, a first electronic module area EMA1 and a second electronic module area EMA2 may be defined in any one of a second display area DA42 and a third display area DA43.

In another alternative exemplary embodiment, as illustrated in FIG. 18C, a display panel DP includes an active area AA and a peripheral area NAA. The active area AA includes a first display area DA51 and a second display area DA52. The first display area DA51 has a triangular shape, and the second display area DA52 has a quadrangular shape.

The first electronic module area EMA1 and the second electronic module area EMA2 may be defined in a portion of the first display area DA51. The light emitting module LM and the camera module CMM illustrated in FIG. 1B are arranged in rear surfaces of the first electronic module area EMA1 and the second electronic module area EMA2. In another embodiment, a first electronic module area EMA1 and a second electronic module area EMA2 may be defined in a second display area DA52.

In another alternative exemplary embodiment, as illustrated in FIG. 18D, a display panel DP includes first to third display surfaces DS1, DS2, and DS3. Although not illustrated in the figure, fourth to sixth display surfaces may further be included in the display panel DP. The display panel DP illustrated in FIG. 18D is a hexahedron having the six display surfaces, but embodiments of the invention are not limited thereto. In one exemplary embodiment, for example, the display panel DP may have various shapes such as a tetrahedron having four display surfaces and a pentahedron having five display surfaces.

The first display surface DS1 includes a first active area AA61 and a first peripheral area NAA61. The second display surface DS2 includes a second active area AA62 and a second peripheral area NAA62. The third display surface DS3 includes a third active area AA63 and a third peripheral area NAA63.

The first electronic module area EMA1 and the second electronic module area EMA2 may be defined in a portion of the second active area AA62 of the second display surface DS2. The light emitting module LM and the camera module CMM illustrated in FIG. 1B are arranged in rear surfaces of the first electronic module area EMA1 and the second electronic module area EMA2. Alternatively, a first electronic module area EMA1 and a second electronic module area EMA2 may be defined in a third active area AA63.

In an exemplary embodiment of the invention, as described above, the display panel DP may include two or more display areas. The two or more display areas may simultaneously display related images or display unrelated images independently of each other. The number and shape of the display areas disposed in the display panel DP may be variously modified. At least one of the display areas may have a relatively higher light transmittance such that the electronic modules disposed in a rear surface thereof may easily detect an external subject or easily provide an outputted optical signal to the outside. At least one of the display areas is flexible and thus the shape thereof may be changed by bending, folding, rolling or the like.

The display device having such a configuration may include the plurality of display areas having shapes different from each other, and may selectively display an image for each of the display areas. Accordingly, different information may be individually displayed in the plurality of display areas of one display device.

In an exemplary embodiment of the display device according to the invention, at least one of the plurality of display areas may include the transmitting area, and the electronic module may be disposed at a position overlapping the transmitting area. Accordingly, the electronic module may easily view external light or a subject through the transmitting area.

Although some exemplary embodiments of the invention have been described herein, it is understood that various changes and modifications can be made by those skilled in the art within the spirit and scope of the invention defined by the following claims and the equivalents. Such exemplary embodiments described herein are not intended to limit the technical spirit and scope of the invention, and all technical spirit within the scope of the following claims and the equivalents will be construed as being included in the scope of the invention.

What is claimed is:

1. A display device comprising:

a display panel comprising a first display area having a first shape and a second display area having a second shape; and a first driving circuit which drives the display panel to display an image in at least one of the first display area and the second display area, wherein the first display area comprises a first sub-area and a second sub-area, wherein the second sub-area comprises a light emitting area and a transmitting area adjacent to the light emitting area and having a higher light transmittance than the light emitting area because an entirety of the transmitting area of the second sub-area is absent any signal lines and any electronic elements, wherein the display panel comprises a first sub-pixel, a second sub-pixel and third sub-pixel disposed on the light emitting area, wherein the transmitting area has a size larger than the sum of sizes of the first sub-pixel, the second sub-pixel and third sub-pixel.

2. The display device of claim 1, wherein the second sub-area is disposed adjacent to the second display area.

3. The display device of claim 1, wherein the display panel comprises:

a base substrate;

a circuit element layer disposed on the base substrate;

a first electrode disposed on the circuit element layer in correspondence to the light emitting area;

a light emitting layer disposed on the first electrode in correspondence to the light emitting area; and a second electrode disposed on the light emitting layer.

4. The display device of claim 1, wherein the display panel comprises:

a base substrate;

a circuit element layer disposed on the base substrate;

a first electrode disposed on the circuit element layer in correspondence to the light emitting area;

a pixel defining film disposed on the circuit element layer to define the light emitting area and the transmitting area;

a light emitting layer disposed on the first electrode in correspondence to the light emitting area; and a second electrode disposed on the light emitting layer, wherein the second electrode does not overlap the transmitting area.

5. The display device of claim 1, wherein the first display area comprises a first driving area, and the second display area comprises a second driving area and a third driving area, the first driving area comprises a first scan driver which drives a plurality of first scan lines, and first pixels respectively connected to the plurality of first scan lines, the second driving area comprises a second scan driver which drives a plurality of second scan lines, and second pixels respectively connected to the plurality of second scan lines, and the third driving area comprises a third scan driver which drives a plurality of third scan lines, and third pixels respectively connected to the plurality of third scan lines.

6. The display device of claim 5, wherein the first driving circuit comprises:

a driving controller which outputs a data signal and a data control signal; and a data driver which drives first data lines and second data lines in response to the data signal and the data control signal, wherein each of the first pixels and the third pixels is connected to a corresponding one of the second data lines, and each of the second pixels is connected to a corresponding one of the first data lines.

7. The display device of claim 6, wherein the driving controller further outputs first to third scan control signals, and the first to third scan drivers operate in synchronization with the first to third scan control signals, respectively.

8. The display device of claim 7, wherein the driving controller outputs the first to third scan control signals in a way such that at least one of the first to third scan drivers is activated.

9. The display device of claim 5, further comprising:

a second driving circuit, wherein the first driving circuit drives the first display area to display an image in the first display area, and the second driving circuit drives the second display area to display an image in the second display area.

10. The display device of claim 9, wherein the first driving circuit comprises:

a first driving controller which outputs a first data signal and a first data control signal; and a first data driver which drives first data lines in response to the first data signal and the first data control signal, and the second driving circuit comprises:

a second driving controller which outputs a second data signal and a second data control signal; and a second data driver which drives second data lines and third data lines in response to the second data signal and the second data control signal, wherein each of the first pixels is connected to a corresponding one of the first data lines, each of the second pixels is connected to a corresponding one of the second data lines, and each of the third pixels is connected to a corresponding one of the third data lines.

11. The display device of claim 10, wherein the first driving controller further outputs a first scan control signal, and the first scan driver operates in synchronization with the first scan control signal.

12. The display device of claim 10, wherein the second driving controller further outputs a second scan control signal and a third scan control signal, and the second scan driver operates in synchronization with the second scan control signal, and the third scan driver operates in synchronization with the third scan control signal.

13. The display device of claim 1, wherein the first shape and the second shape are different from each other in at least one of area and shape.

14. The display device of claim 1, further comprising:

an electronic module disposed to overlap the display panel, wherein the transmitting area of the second sub-area overlaps the electronic module.

15. The display device of claim 14, wherein the second sub-area is disposed adjacent to the second display area.

16. The display device of claim 14, wherein the first display area comprises a first driving area, the second display area comprises a second driving area and a third driving area, the first driving area comprises a first scan driver which drives a plurality of first scan lines, and first pixels respectively connected to the plurality of first scan lines, the second driving area comprises a second scan driver which drives a plurality of second scan lines, and second pixels respectively connected to the plurality of second scan lines, and the third driving area comprises a third scan driver which drives a plurality of third scan lines, and third pixels respectively connected to the plurality of third scan lines.

17. The display device of claim 16, wherein the first driving circuit comprises:

a driving controller which outputs a data signal and a data control signal; and a data driver which drives first data lines and second data lines in response to the data signal and the data control signal, wherein each of the first pixels and the third pixels is connected to a corresponding one of the second data lines, and each of the second pixels is connected to a corresponding one of the first data lines.

18. The display device of claim 17, wherein the driving controller further outputs first to third scan control signals, and the first to third scan drivers operate in synchronization with the first to third scan control signals, respectively.

19. A display device comprising:

a display panel comprising a first display area having a first shape and a second display area having a second shape; and a first driving circuit which drives the display panel to display an image in at least one of the first display area and the second display area, wherein the display panel is bendable with respect to a first bending axis in a boundary area between the first display area and the second display area, which are adjacent to each other, wherein the first display area comprises a first sub-area and a second sub-area, and the second sub-area comprises a light emitting area and a transmitting area adjacent to the light emitting area and having a higher light transmittance than the light emitting area because an entirety of the transmitting area of the second sub-area is absent any signal lines and any electronic elements in a path of light through the display panel in a thickness direction of the display panel, wherein the display panel comprises a first sub-pixel, a second sub-pixel and third sub-pixel disposed on the light emitting area, wherein the transmitting area has a size larger than the sum of sizes of the first sub-pixel, the second sub-pixel and third sub-pixel.

20. The display device of claim 19, wherein the second sub-area is disposed adjacent to the second display area.

21. The display device of claim 19, wherein in a state where the display panel is bent with respect to the first bending axis, the first driving circuit drives the display panel to display an image in at least one of the first display area and the second display area.

22. The display device of claim 19, further comprising:

a second driving circuit, wherein the first driving circuit drives the first display area to display an image in the first display area, and wherein the second driving circuit drives the second display area to display an image in the second display area.

23. A display device comprising:

a display panel comprising a composite area having a first shape and a second display area having a second shape; and a driving circuit which drives the display panel to display an image in at least one of the composite area and the second display area, wherein the composite area comprises a first display area which displays the image and a transparent area which does not display the image and does not display any image at any time, wherein the first display area comprises a light emitting area and a transmitting area adjacent to the light emitting area, wherein the display panel comprises a first sub-pixel, a second sub-pixel and third sub-pixel disposed on the light emitting area, wherein the transmitting area has a size larger than the sum of sizes of the first sub-pixel, the second sub-pixel and third sub-pixel.

24. The display device of claim 23, wherein the driving circuit drives the display panel to display the image in both the first display area and the second display area in a first mode.

25. The display device of claim 23, wherein the driving circuit drives the display panel to display the image in one of the first display area and the second display area in a second mode.

26. The display device of claim 23, wherein the second display area comprises a first driving area and a second driving area, and the driving circuit drives the display panel to display the image in the first display area and at least one of the first driving area and the second driving area in a third mode.

27. The display device of claim 26, wherein the transparent area is adjacent to at least one of the first driving area and the second driving area.

* * * * *